US011624236B2

(12) United States Patent
Smart

(10) Patent No.: US 11,624,236 B2
(45) Date of Patent: Apr. 11, 2023

(54) RATCHETING AUGER BRACE DEVICE

(71) Applicant: Terry Smart, Peebles, OH (US)

(72) Inventor: Terry Smart, Peebles, OH (US)

( * ) Notice: Subject to any disclaimer, the term of this patent is extended or adjusted under 35 U.S.C. 154(b) by 270 days.

(21) Appl. No.: 17/073,629

(22) Filed: Oct. 19, 2020

(65) Prior Publication Data

US 2021/0123304 A1 Apr. 29, 2021

Related U.S. Application Data

(60) Provisional application No. 62/980,688, filed on Feb. 24, 2020, provisional application No. 62/926,762, filed on Oct. 28, 2019.

(51) Int. Cl.

| | |
|---|---|
| ***E21B 7/02*** | (2006.01) |
| ***E21B 10/44*** | (2006.01) |
| ***E21B 7/00*** | (2006.01) |
| ***E21B 19/24*** | (2006.01) |

(52) U.S. Cl.

CPC ..... *E21B 7/027* (2013.01); *E21B 7/005* (2013.01); *E21B 10/44* (2013.01); *E21B 19/24* (2013.01)

(58) Field of Classification Search

CPC ..... E21B 19/24; E21B 7/027; E21B 7/005; E21B 10/44

See application file for complete search history.

(56) References Cited

U.S. PATENT DOCUMENTS

| | | | | |
|---|---|---|---|---|
| 2,221,680 | A | 11/1940 | Parrish | |
| 5,695,016 | A | 12/1997 | Deeter et al. | |
| 6,315,059 | B1 | 11/2001 | Geldean | |
| 6,742,747 | B1 * | 6/2004 | Timmons, Jr. ..... | E02F 3/06 248/525 |
| 6,749,032 | B2 | 6/2004 | Snyder, Sr. | |
| 7,614,463 | B1 | 11/2009 | Hunziker | |
| 9,452,523 | B2 | 9/2016 | Hokanson | |
| 2004/0089479 | A1 | 5/2004 | Snyder, Sr. | |
| 2011/0135412 | A1 * | 6/2011 | Duncan ..... | B28D 1/041 408/72 R |
| 2012/0234780 | A1 | 9/2012 | Hokanson | |
| 2015/0209954 | A1 | 7/2015 | Hokanson | |
| 2019/0186211 | A1 * | 6/2019 | Gonzalez Gonzalez ..... | E21B 15/003 |

* cited by examiner

*Primary Examiner* — Nicole Coy

*Assistant Examiner* — Nicholas D Wlodarski

(74) *Attorney, Agent, or Firm* — Daniel F. Nesbitt; Nesbitt IP LLC

(57) ABSTRACT

A ratcheting auger bracing device having a support frame with spaced-apart elongated side bars and first and second end bars connecting the side bars, and a pair of pivotable braces each having a proximal hinge end secured pivotally to and around the end bars of the support frame, a distal end bar, and a pair of opposed arms connecting the distal end bar to the proximal hinge end. The opposed arms are angled downwardly, acing the shaft of the auger section, to provide improved operation of the ratcheting auger bracing device in muddy operation conditions. An elevating frame provides an elevating base and legs that elevate the support frame and the hinged pair of pivotable braces at a distance above the ground level, and positions the hinged ends of the pivotable braces a distance above the ground level that avoids or prevents mud that may pool around the well hole.

19 Claims, 23 Drawing Sheets

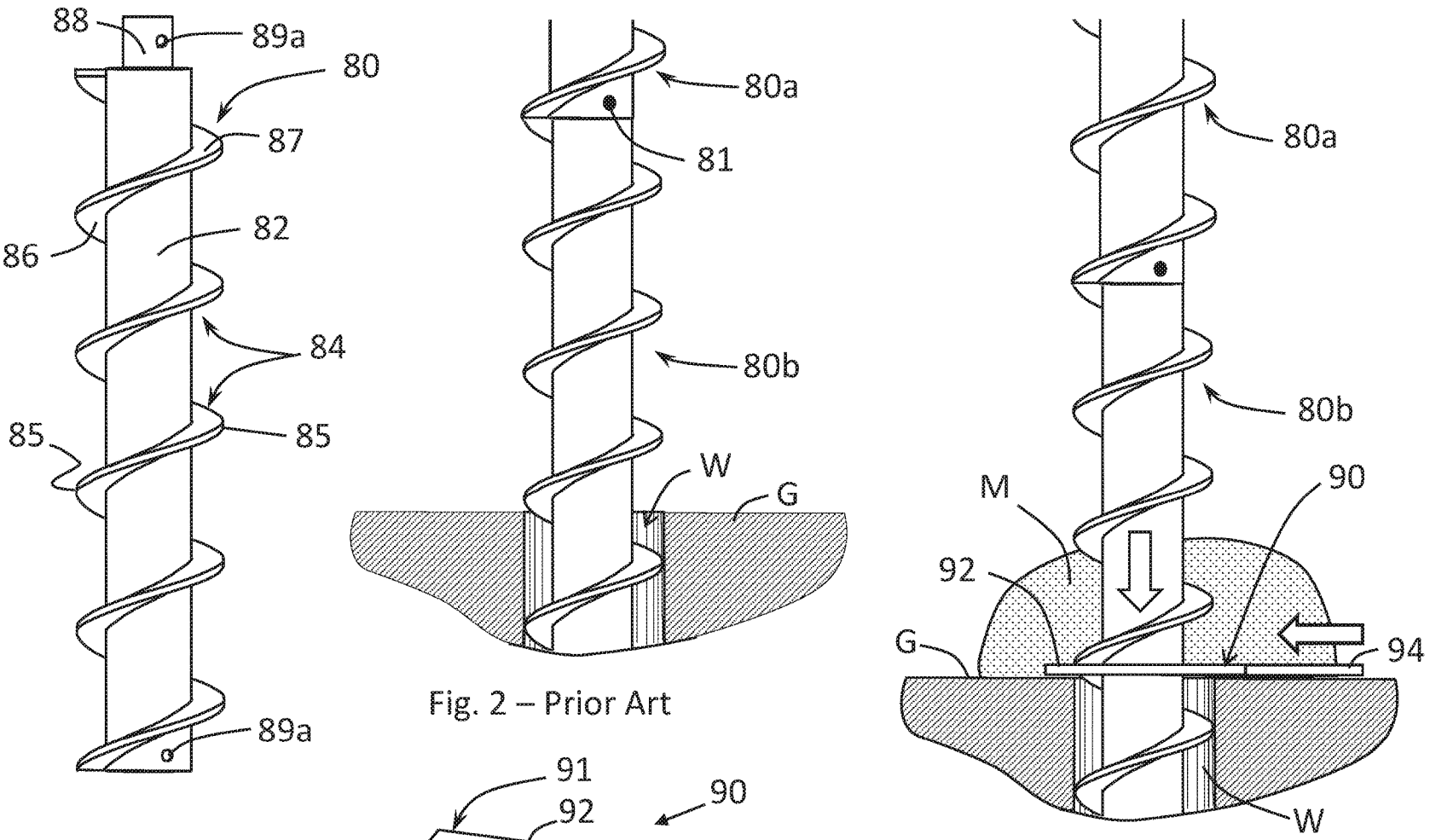
Fig. 1 – Prior Art
Fig. 2 – Prior Art
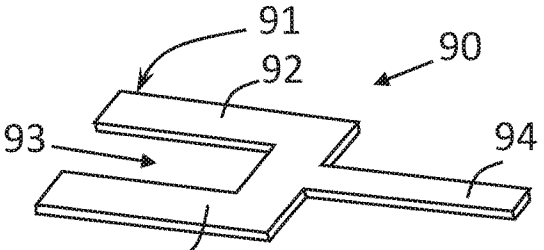
Fig. 3 – Prior Art
Fig. 4 – Prior Art

RATCHETING AUGER BRACE DEVICE

CROSS-REFERENCE TO RELATED APPLICATIONS

This application claims the benefit of U.S. Provisional Application No. 62/926,762 filed Oct. 28, 2019, and also U.S. Provisional Application No. 62/980,688 filed Feb. 24, 2020, the disclosures of which are hereby incorporated by reference in their entireties.

TECHNICAL FIELD

The technology described herein generally relates to augers for drilling ground wells.

BACKGROUND OF THE INVENTION

Various method are used for drilling wells for ground water monitoring for environmental and geotechnical applications. One method uses a hollow stem auger which not only bores the well hole, but can also be used to obtain soil samples. Hollow stem auger drilling uses a large diameter (up to 14 inch outside diameter) continuous flight augers which mechanically excavate and continuously transport cuttings to the surface. A center bit, which is attached to the drill rod and bolted to the auger drive cap, is inserted through the cutter head to excavate the center of the boring. As the boring is advanced by adding sections of auger, sections of drill rod are added, maintaining the center bit at the face of the cutter bit.

Another method uses a solid stem auger uses a claw bit to advance sections of solid stem augers into the ground. The drilling equipment applies pressure and rotation against the top of the stem of the upper-most auger section while turning the sections into the ground. The claw bit displaces the soil and moves it up the helical flights of the auger sections as the drill bores deeper into the ground. The solid stem auger is inserted in sections that are several feet long and from 6 to 12 inches in diameter and 4-6 feet long, with 4-6 flights of a helical blade that spirals around the center shaft. Each auger section is assembled in-hole by disconnecting the drilling apparatus from the top end of an in-ground auger section that is partly into the ground, and attaching a bottom end of a next auger section onto the top end of an in-ground auger section that is partly into the ground. The drilling apparatus is the reconnected to the top end of the next auger section, and the drilling continues until the next auger section becomes the in-ground auger section, and the next auger section is added in the same way.

A typical solid stem auger section is shown in FIG. 1. The illustrated auger section 80 has an elongates stem or shaft 82, including a post 88 extending the top end, and an open (not shown) bottom end configured to accept a post 88 of a next auger section 80 in the series. The post 88 has a transverse hole 89*a*, and the bottom end has a mating transverse hole 89*b* that aligns with the transverse hole 89*a* of the post 88 when the two sections are attached and rotationally oriented. The auger section 80 also includes a helical blade 84 having five flights, each flight spiraling around the outer cylindrical surface of the shaft 82, and having an upper spiraling surface 87 and a lower spiraling surface 86.

FIG. 2 illustrates an in-ground auger section 80*b*, with an upper auger section 80*a* attached and rotationally oriented with the in-ground auger section 80*b*, and with a pin 81 secured into the aligned transverse holes 89*a*,89*b* to secure and lock the two auger sections 80*a*,80*b* together both rotatively and axially.

Once a well hole W has been drilled with a solid stem auger, the series of auger sections 80 are withdrawn from the well hole. During withdrawal of the auger sections, the drilling equipment 70 raises the series of auger sections, typically while also rotating to help move soil and mud within the helical flights. To disassemble the upper auger section 80*a* from the in-ground auger section 80*b*, the drilling rotation of the series of auger sections is stopped, and a brace is placed around the shaft 82 and between the flights of blades 84 of the in-ground auger section 80*b*, at ground level. In the illustrated embodiment shown in FIG. 3, the brace is shown as a fork 90 having a pair of spaced-away fingers 92 attached to a handle 94. The two fingers 92 are placed with space 93 between the fingers around the shaft 82 and under the helical blade 84 (horizontal arrow), and the drilling equipment 70 then carefully lowers the series (vertical arrow) of augers sections until the helical blade 84 rests upon one or the other finger 92, which while resting on the surface of the ground and spanning across the well hole W, bears the entire weight of the series of augers sections remaining in the well hole, as shown in FIG. 4. The pin 81 is then removed from the transverse holes 89*a*,89*b*, and the upper auger section 80*a* is lifted up from the in-ground auger section (illustrated in an embodiment of the invention in FIG. 16) and placed aside. The drilling equipment 70 is then attached to the top post 88 of the in-ground auger section 80*b*. The drilling equipment 70 then must raise the series of auger sections still in the well hole, so that the brace 90 can be withdrawn from around the shaft 82 and from between the lights of the helical blades 84. The rotation and withdrawing of the next auger section 80*b* again commence, and the procedure is repeated for each of the remaining in-ground auger sections in kind, until the last auger section and the claw bit are removed from the well hole.

The use of the fork brace 90 is satisfactory but has several drawbacks. First, it must be inserted between the helical blades 84 by hand, before lowering the series of auger sections so that the drilling equipment can be detached from an auger section and the withdrawn auger section removed from the remaining series of auger sections, and also withdrawn by hand from between the helical blades after the withdrawn auger section is removed and the drilling equipment reattached. Also, since mud and water are commonly withdrawn from the well hole along with the auger sections, the area of ground surrounding the well hole W can become deep in mud, making handling of the fork brace 90 difficult and uncertain.

Notwithstanding, there is a continuing need for an improved method for bracing the series of auger sections during their withdrawal, which is easier to work with, safer, and avoids the problems described herein above.

SUMMARY OF THE INVENTION

The present invention provides a ratcheting auger bracing device, comprising: (a) a support frame comprising a peripheral tubular assembly, having an interior area bounded by the peripheral tubular assembly; (b) a first pivotable brace, including a proximal hinge end secured pivotally to and around the first end bar of the support frame, a distal elongated end bar having opposed lateral ends, and a pair of opposed arms, each having a distal end rigidly connecting to the respective opposed lateral ends of the distal end bar, and a proximal end rigidly connecting to the proximal hinge end;

and (c) a second pivotable brace, including a proximal hinge end secured pivotally to and around the second end bar of the support frame, a distal elongated end bar having opposed lateral ends, and a pair of opposed arms, each having a distal end rigidly connecting to the respective opposed lateral ends of the distal end bar, and a proximal end rigidly connecting to the proximal hinge end.

In some embodiments, the pair of opposed arms of the first pivotable brace and the pair of opposed arms of the second pivotable brace are linear and straight. In some embodiments, the pair of opposed arms of the first pivotable brace and the pair of opposed arms of the second pivotable brace are angled, and each of the arms includes a proximal arm member and a distal arm member joined at an elbow at an angle.

In some embodiments, each of the first pivotable brace and the second pivotable brace further includes an outer cylindrical bar surrounding coaxially, and rotatable freely around, the fixed distal elongated end bar.

In some embodiments, the proximal hinge end comprises one or more outer cylindrical bar surrounding coaxially, and rotatable freely around, the respective the first and second end bars of the support frame.

In some embodiments, the peripheral tubular assembly includes a pair of spaced-apart elongated side bars, a first elongated end bar connecting the pair of side bars at a first end, and a second elongated end bar connecting the pair of side bars at a second end opposite the first end.

Typically, the peripheral tubular assembly has an undersurface that is planar to rest upon a flat ground surface without rocking. In some embodiments, the peripheral tubular assembly includes a tubular member in the shape of an oval.

The present invention also provides an elevated ratcheting auger bracing device, comprising the ratcheting auger bracing device described herein, which is elevated by including an elevating frame that rests upon the surface of the ground surrounding a well hole, for raising or elevating the support frame and the opposed pair of pivotable braces a distance above the ground level. The elevating frame positions the hinged ends of the pivotable braces a distance above the ground level that avoids or prevents a pooling of mud that may be raised out of the well hole and may accumulate on the ground surrounding the well hole.

In some embodiments of the elevated ratcheting auger bracing device, the pair of opposed arms of the first pivotable brace and the pair of opposed arms of the second pivotable brace are linear and straight. In some embodiments thereof, the pair of opposed arms of the first pivotable brace and the pair of opposed arms of the second pivotable brace are angled, and each of the arms includes a proximal arm member and a distal arm member joined at an elbow at an angle.

In another embodiment of the invention, an elevated ratcheting auger bracing device can include an elevating frame that rests upon the surface of the ground surrounding a well hole, for raising or elevating the support frame and the opposed pair of pivotable braces a distance above the ground level. The elevating frame positions the hinged ends of the pivotable braces a distance above the ground level that avoids or prevents a pooling of mud that may be raised out of the well hole and may accumulate on the ground surrounding the well hole. The raising of the hinge ends of the pivotable braces minimizes or eliminates their soiling and fowling by the accumulated mud, and increases the time and the amount of mud that can accumulate around the well hole before the need to halt the auger withdrawal process and clear away accumulated mud. In some embodiments and circumstances, the accumulated mud can be pulled away from the area around the well hole, and from within the space confined by the elevating base, that avoids the need for halting the auger withdrawal process.

The present invention also includes a method for using the ratcheting auger bracing device for extracting sections of an auger from a well hole. The method can include the steps of positioning a support brace substantially symmetrically around a well hole in which sections of an auger are disposed. After positioning the support brace, the two opposed braces are pivoted inwardly toward a section of the auger extending upward from the well hole, until a distal bar at the end of the arms of each brace contact the shaft and/or helical blade of the auger section, whereby gravity pulls the pivoted braces against the auger section. As a section of auger is pulled upward out of the well hole, the successive rising helical blades of the auger section lifts upward and pivots outward the two opposed braces in alternating sequence. After a brace clears the rising edge of a helical blade, the distal bar of the brace falls by gravity against the shaft of the auger section. Further rising of the auger section repeats the action of the brace pivoting outwardly and falling back against the shaft. An auger section is raised sufficiently out of the well hole to cause the opposed braces of the ratcheting auger bracing device to come to rest under the helical blade of the next auger section below. This allows the raised auger section to be disconnected from the remaining auger sections below, while the weight of the remaining sections below are supported by the braces of the ratcheting auger bracing device. The auger hoist used to raise the auger sections is disconnected from the raised auger section, which is set aside. Once disconnected, the auger hoist is attached to the upper end of the next auger section, and the extracting of the next auger section from the well proceeds.

As the ratcheting auger bracing device can be used to support the auger sections without a human user needing to manipulate (insert and withdraw) a support fork, one can consider the ratcheting auger bracing device as a "smart fork" or a "Smart fork".

These and other features and advantages of the present invention will become better understood with reference to the following drawings, description and claims.

BRIEF DESCRIPTION OF THE DRAWINGS

FIG. 1 illustrates an auger section of the prior art.

FIG. 2 illustrates a series of auger sections of FIG. 1 within a well hole.

FIG. 3 illustrates a fork brace of the prior art used to support the weight of the series of auger sections within the well hole.

FIG. 4 illustrates the prior-art fork brace in use to support the weight of the series of auger sections within the well hole.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 6:
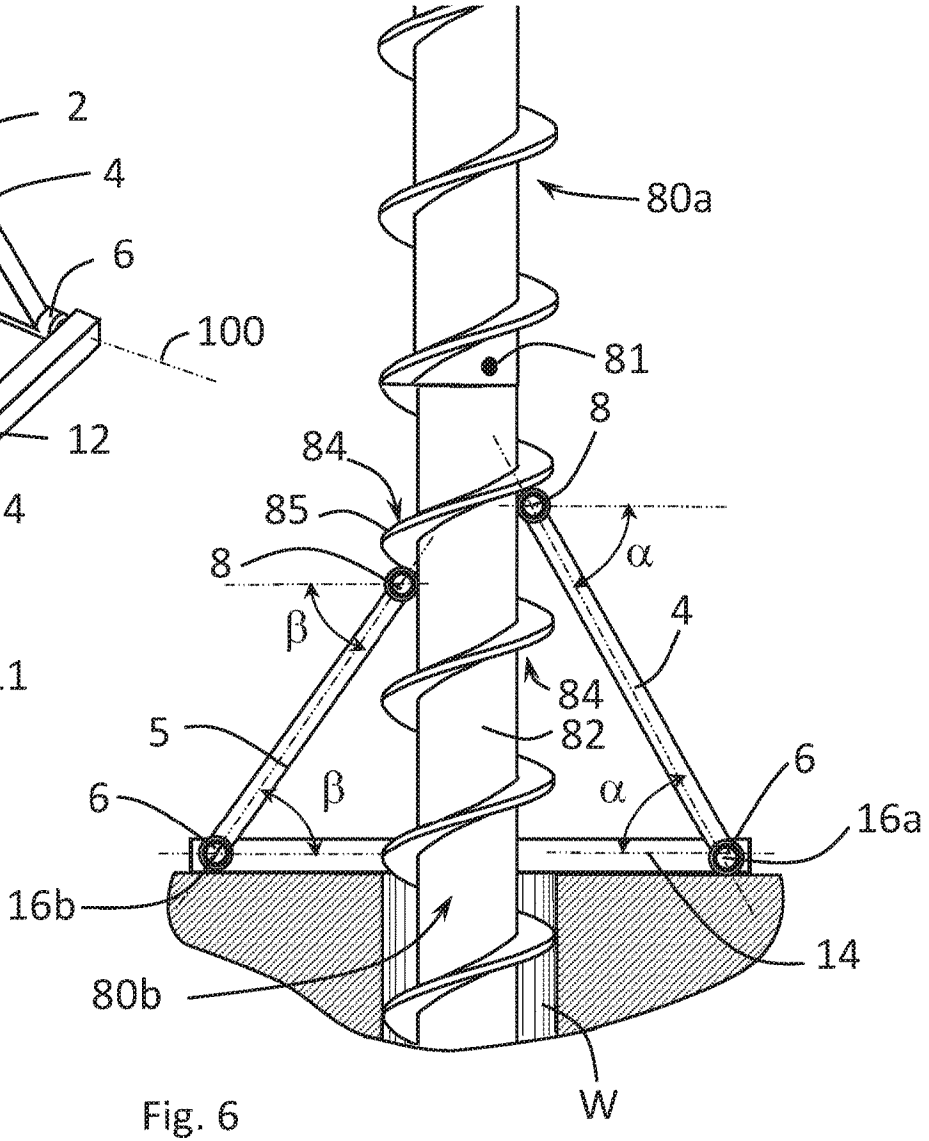
FIG. 6 illustrates the ratcheting auger bracing device of FIG. 5 positioned around and supporting a series of auger sections within a well hole.
Figure 5:
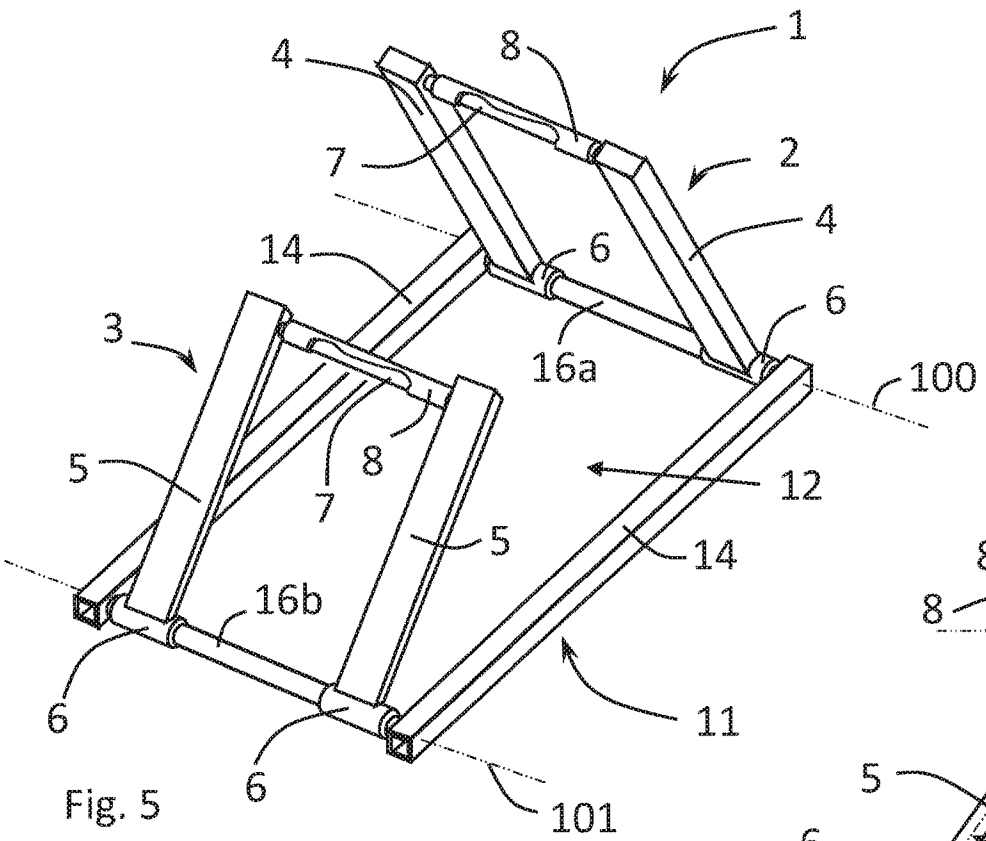
FIG. 5 illustrates a first embodiment of a ratcheting auger bracing device having linear arms.

FIG. 5 is a first embodiment of a ratcheting auger bracing device 1, comprising a support frame 11, a first pivotable brace 2, and a second pivotable brace 3. FIG. 6 is a side elevation view thereof.

The support frame comprising a peripheral tubular assembly, having an interior area bounded by the peripheral tubular assembly. The shape of the outer peripheral tubular assembly can be square, rectangular, round, oval, and even triangular, provided it has a periphery shape that provides for support for the pivotable braces described below.

In the illustrated embodiment, the support frame 11 includes a pair of spaced-apart and substantially parallel side bars 14. A first elongated end bar **16*a* connects rigidly the pair of side bars 14 at a first end, and a second elongated end bar 16*b* connects rigidly the pair of side bars 14 at a second end opposite the first end. Typically, the sides bars 14 are rectangular cylinders, while the first and second end bars 16*a*,16*b* are round cylinders. The support frame 11 is configured in length along the side bars 14, and laterally along the end bars 16, to provide an interior area 12, bounded by the pair of side bars 14, the first end bar 16*a* and the second end bar 16*b*, that is sufficiently long and laterally broad to accommodate the full diameter of a well hole W and an auger section 80** there within.

The first pivotable brace 2 and the second pivotable brace 3 are similar in configuration, and the description below for the first pivotable brace 2 applies as well for the second pivotable brace 3 except as indicated.

The first pivotable brace 2 includes a proximal hinge end, a pair of arms 4, and a distal end bar 7. The proximal hinge end secures pivotally the first pivotable brace 2 to the first end bar 16*a* of the support frame 11. The hinge end can comprise one or more outer tubular cylinders, illustrated as a pair of axially-aligned and axially-spaced-apart circular cylinders 6, that are concentrically and pivotally around the first end bar 16*a* of the support frame 11. The inner diameter of the circular cylinders 6 is sufficient to rotatable freely around the first end bar 16*a*, with only minimal frictional interference therebetween.

A pair of opposed arms 4 have a proximal end at which the arms 4 are fixed to and extend from the pair of hinged-end outer cylinders 6, and extend distally to a distal end. In the illustrated embodiment, the arms 4 are made of a rectangular cylinder.

The distal end bar 7 is elongated and extends between and is secured to the distal ends of the pair of arms 4. The distal end bar 7 extends substantially parallel to the hinge end circular cylinders 6, and perpendicular to the arms 4. In the illustrated embodiment, the first pivotable brace 2 (and the second pivotable brace 3) further includes an outer cylindrical bar 8 surrounding coaxially, and rotatable freely around, the fixed, distal end bar 7. The outer cylindrical bar 8 is illustrated as a circular cylinder that surrounds coaxially the distal end bar 7. The inner diameter of the circular cylinder 8 is sufficient for the circular cylinder 8 to rotatable freely around the distal end bar 7, with only minimal frictional interference therebetween.

In this embodiment shows the pair of opposed arms 4 of the first pivotable brace and the pair of opposed arms 5 of the second pivotable brace as linear and straight rectangular, cylindrical bars. The pair of arms 4 of the first pivotable brace is configured in distal length to extend from the plane of the support frame 11 at an angle $\alpha$ of about 20° to 60° when the distal elongated end bar thereof rests against the outer surface of the shaft, between flights of the helical blade, and pair of arms 5 of the second pivotable brace is configured in distal length to extend from the plane of the support frame 11 at an angle $\beta$ of about 20° to 60° when the distal elongated end bar 7 (or outer cylindrical bar 8) thereof rests against the outer surface of the shaft 82, between successive flights of the helical blade 84. To account for the downward spiral of the helical blade 84 along the outer surface of the shaft 82, the pair of arms 4 of the first pivotable brace 2 are slightly longer than the pair of arms 5 of the second pivotable brace 3, such that the respective distal end bar 7 of the first pivotable brace 2 and the second pivotable brace 3 contacts the shaft 82 in approximately the same height between successive flights of the helical blade 84 when the support frame 11 is positioned symmetrically about the shaft 82 and the well hole W. As the shaft 82 of the auger section 80 is typically vertical within the well hole W, and the support frame 11 is typically horizontal resting on the surface of the ground G, the distal ends of the respective pairs of opposed arms 4,5 likewise extend from a horizontal line perpendicular to the axis of the shaft 82 at a similar angle $\alpha$,$\beta$ of about 20° to 60°, depending upon the positioning of the support frame 11 around the shaft 82.

Figures 7, 8:
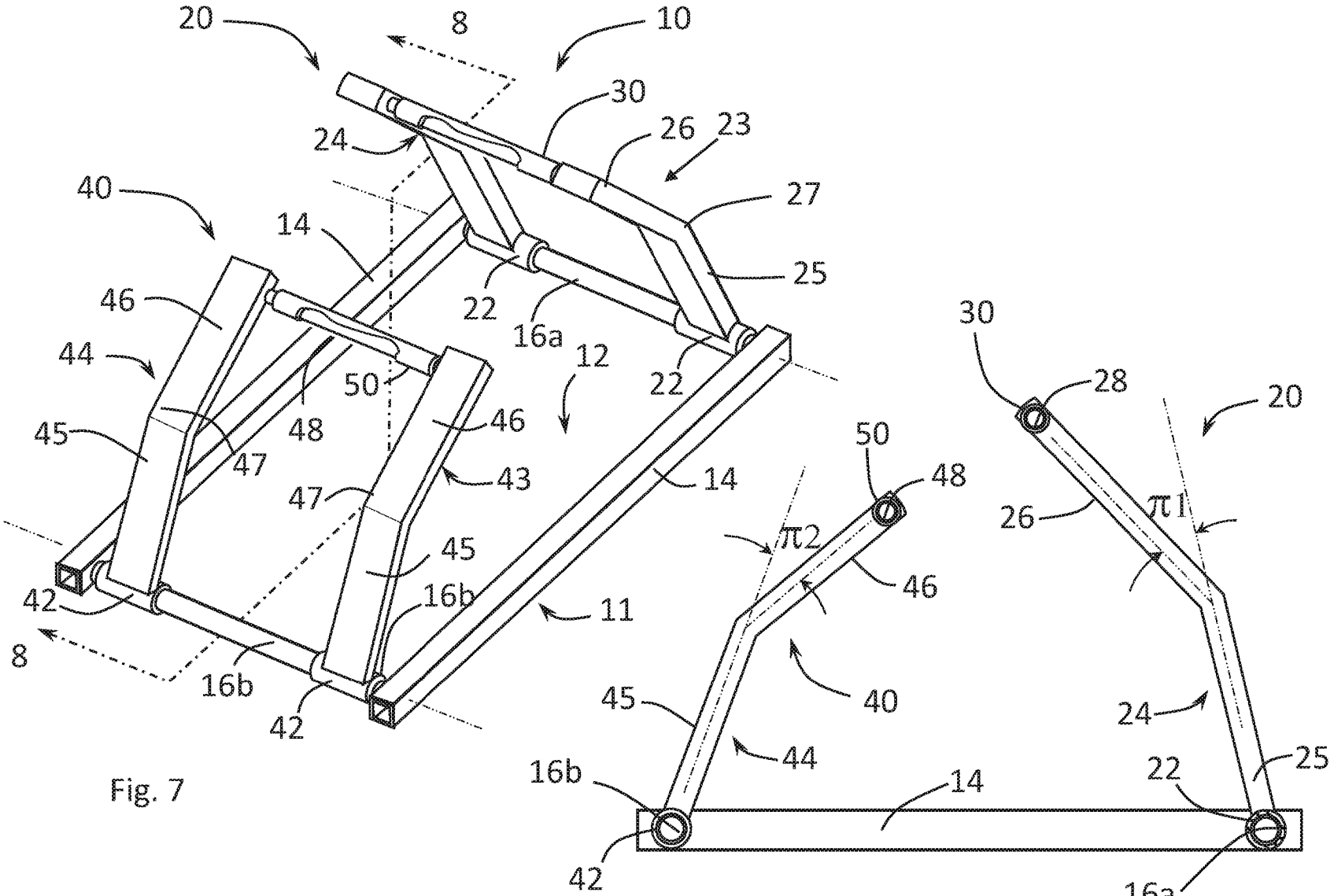
FIG. 7 illustrates a perspective view of a second and improved embodiment of a ratcheting auger bracing device having angular arms.
FIG. 8 illustrates a side elevation view of the ratcheting auger bracing device of FIG. 7.
Figure 9:
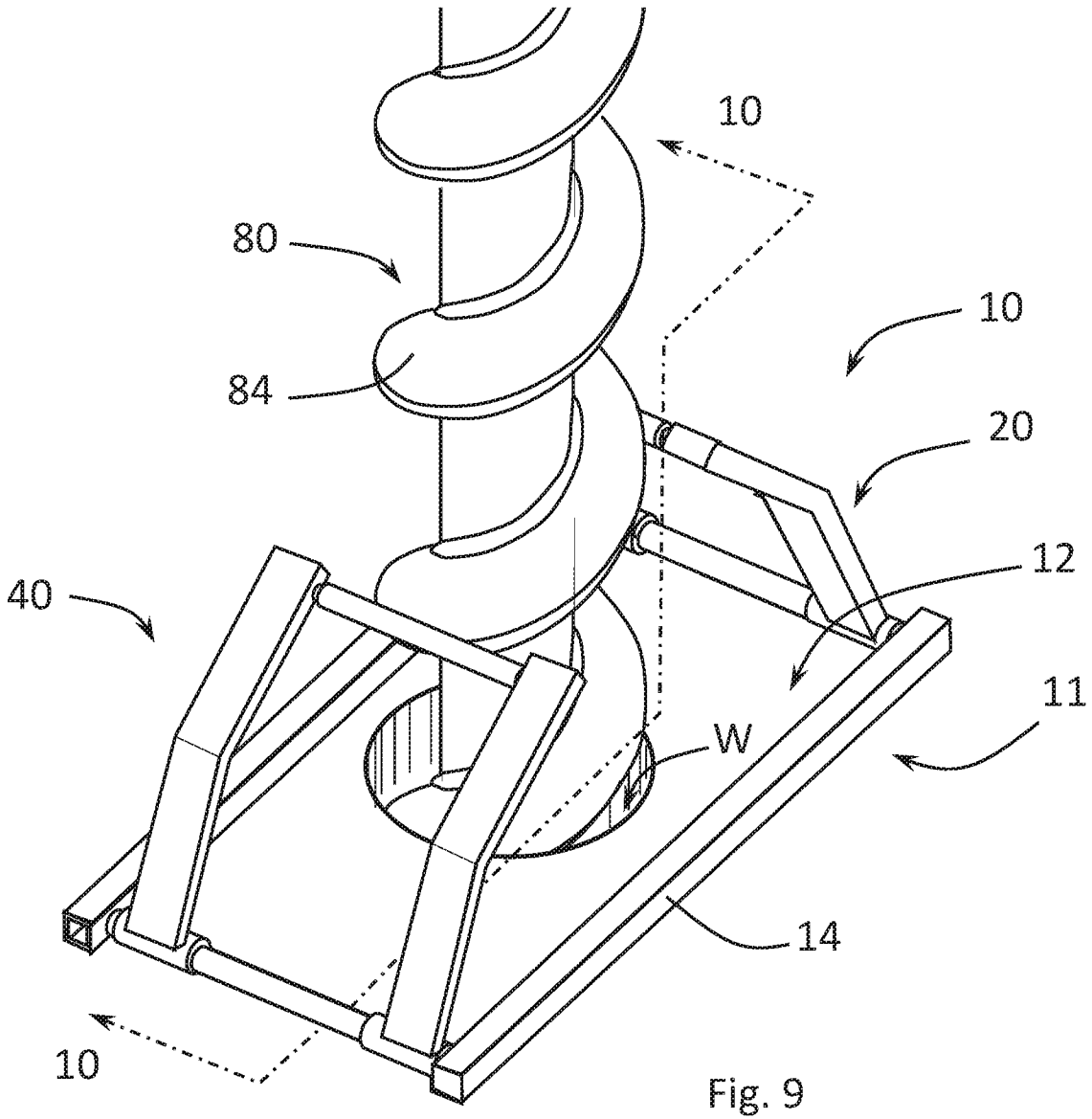
FIG. 9 illustrates a perspective view of said ratcheting auger bracing device positioned around an auger section within a well hole.

FIG. 7 is a second embodiment of a ratcheting auger bracing device 10, comprising a support frame 11, a first pivotable brace 20, and a second pivotable brace 40. FIG. 8 is a side elevation view thereof, and FIG. 9 illustrates a perspective view of the support frame 11 positioned around an auger section 80 disposed within a well hole W.

The first pivotable brace 20 includes a proximal hinge end, a pair of arms 23,24, and a distal end bar 28. The proximal hinge end secures pivotally the first pivotable brace 20 to the first end bar 16*a* of the support frame 11. The hinge end can comprise one or more outer cylinders, illustrated as a pair of axially-aligned and axially-spaced-apart circular cylinders 22, that are concentrically and pivotally around the first end bar 16*a* of the support frame 11. The inner diameter of the circular cylinders 22 is sufficient to rotatable freely around the first end bar 16*a*, with only minimal frictional interference therebetween. It can be understood that the single outer cylinder can be used in place of the pair of spared-apart outer cylinder 22, as shown by outer cylinder 122 in FIG. 19 of another embodiment herein.

The second pivotable brace 40 includes a proximal hinge end, a pair of angular arms 43,44, and a distal end bar 48. The proximal hinge end secures pivotally the second pivotable brace 40 to the second end bar 16*b* of the support frame 11. The hinge end can comprise one or more outer cylinders, illustrated as a pair of axially-aligned and axially-spaced-apart circular cylinders 42, that are concentrically and pivotally around the first end bar 16*b* of the support frame 11. The inner diameter of the circular cylinders 42 is sufficient to rotatable freely around the first end bar 16*b*, with only minimal frictional interference therebetween. It can be understood that the single outer cylinder can be used in place of the pair of spared-apart outer cylinder 42, as shown by outer cylinder 142 in FIG. 19 of another embodiment herein.

The first pivotable brace 20 also includes a pair of opposed, angular arms 23, 24, each having a proximal end at which the angular arms 23,24 are fixed to and extend from the respective hinged-end outer cylinders 22, and extend distally to a distal end. The angular arms 23,24 include respectively a proximal member 25 and a distal member 26 that are fixed angularly at a joint 27. In the illustrated embodiment, the lengths of the proximal member 25 and the distal member 26 are the same, and the joint 27 is in the middle of the length of each angular arm 23,24. In some embodiments, the length of the proximal member 25 can be 10%-100% longer than the length of the distal member 26, while in other embodiments, the length of the distal member 26 can be 10%-100% longer than the length of the proximal member 25. The angle $\pi 1$ of the joint 27 can be from about 10° to about 50°. In some embodiments, the angle $\pi 1$ is at least about 15°, for example, at least about 20°, at least about 25°, or at least about 30°, and up to about 45°, for example, up to about 40°, up to about 35°.

The second pivotable brace 40 has a pair of opposed angular arms 43,44, including proximal member 45 and distal member 46 fixed angularly at a joint 47, which are similar in configuration to such features of the first pivotable brace 20, and the description for such features of the angular arms 23,24 of the first pivotable brace 20, including that of the angle $\pi 2$ of the joint 47, applies as well for such features of the angular arms 43,44 of the second pivotable brace 40, except as indicated.

Figure 19:
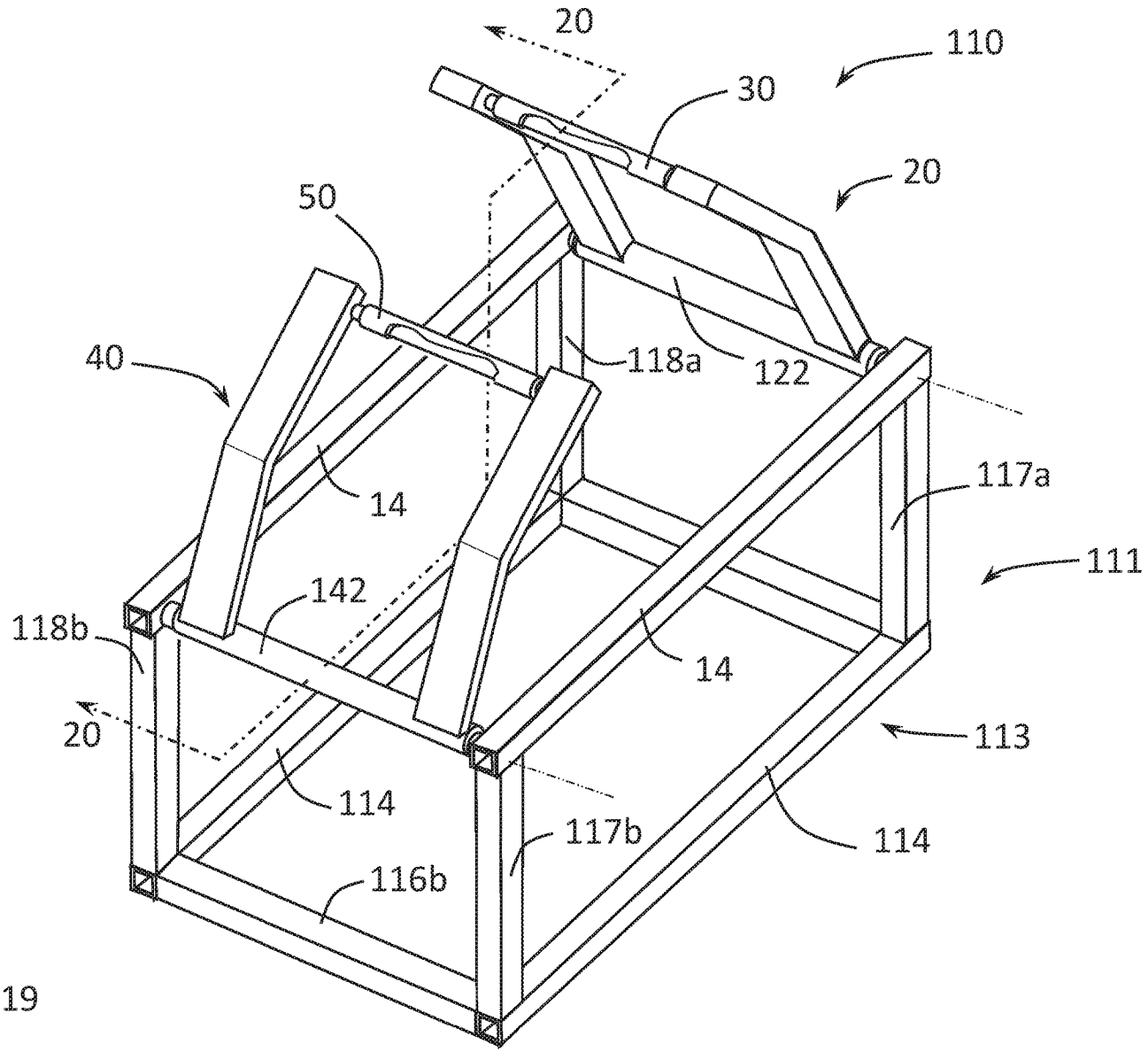
FIG. 19 illustrates a perspective view of a fourth embodiment of a ratcheting auger bracing device having angular-armed braces and an elevating frame.

It can be understood that the pair of opposed, angular arms 23, 24 can be fixed to and extend from a single outer cylinder, that the second pair of opposed, angular arms 43, 44 can be fixed to and extend from a single outer cylinder, as shown by outer cylinders 122 and 142 in FIG. 19 of another embodiment herein.

The first pivotable brace 20 also includes a distal end bar 28 that is elongated and extends between and is secured to the distal ends of the pair of angular arms 23,24. The distal end bar 28 extends substantially parallel to the hinge end circular cylinders 22, and perpendicular to the angular arms 23,24. Similarly, the second pivotable brace 40 also includes a distal end bar 48 that is elongated and extends between and is secured to the distal ends of the pair of angular arms 43,44. The distal end bar 48 extends substantially parallel to the hinge end circular cylinders 42, and perpendicular to the angular arms 43,44.

In the illustrated embodiment, the first pivotable brace 20 and the second pivotable brace 40, respectively, further include an outer cylindrical bar 30,50 surrounding coaxially, and rotatable freely around, the fixed, distal end bars 28,48, respectively. The outer cylindrical bars 30,50 are illustrated as circular cylinders that surround coaxially the distal end bars 28,48. The inner diameter of the circular cylinders 30,50 are sufficient for the circular cylinder 30,50 to rotatable freely around the distal end bars 28,48, with only minimal frictional interference therebetween.

In another embodiment, the distal end bars 28,48 each can comprise solid bars, rather than hollow cylinder bars, to increase the weight at the distal end of the arms, to improve the torque resulting from gravity to pull the distal ends of the arms back toward the shaft of the 82 of the auger section 80.

In this second embodiment, the pair of angular arms 23,24 of the first pivotable brace is configured in distal length to extend from the plane of the support frame 11, from the hinge end circular cylinders 22 to the distal end bar 28, at an angle $\alpha$ of about 20° to 60° when the distal elongated end bar 28 (or outer circular cylinders 30) thereof rests against the outer surface of the shaft 82, between flights of the helical blade 84. Likewise, the pair of angular arms 43,44 of the second pivotable brace 40 is configured in distal length to extend from the plane of the support frame 11, from the hinge end circular cylinders 42 to the distal end bar 48, at an angle $\beta$ of about 20° to 60° when the distal elongated end bar 48 (or outer circular cylinders 50) thereof rests against the outer surface of the shaft 82, between flights of the helical blade 84.

To account for the downward spiral of the helical blade 84 along the outer surface of the shaft 82, the pair of angular arms 23,24 of the first pivotable brace 20 are slightly longer, from the hinge end circular cylinders 42 to the distal end bar 48, than the pair of angular arms 43,44 of the second pivotable brace 40, such that the respective distal end bars 28,48 of the first pivotable brace 20 and the second pivotable brace 40 contact the shaft 82 in approximately the same height between successive flights of the helical blade 82 when the support frame 11 is positioned symmetrically about the shaft 82 and the well hole W. This also has the advantage that the distal end bars 28,48 of the opposed pair of pivotable braces 20,40 engage the helical blade 84 from the underside 86 at the same time when the lengths of auger sections are lowered onto the ratcheting auger bracing device 10 during withdrawal of the auger sections, as described herein later, which maintains opposite and balanced forces upon the two opposed pivotable braces 20,40.

However, because the respective angular arms 23,24 of the first pivotable brace 20 are angled downwardly, when the first pivotable brace 20 is in contact with the surface of the shaft 82, the angle $\kappa 1$ formed by the proximal member 25 of the angular arms 23,24 from the horizontal plane of the support frame 11, is larger than the angle $\alpha$, typically larger by about 5°, and up to about 25°. In some embodiments, the angle $\kappa 1$ is larger than angle $\alpha$ by at least about 10°, for example, at least about 15°, and up to about 20°. Conversely, the angle $\kappa 2$ formed by the distal member 26 of the angular arms 23,24 from a horizontal line perpendicular to the axis of the shaft 82, is smaller than the angle $\alpha$, typically also smaller by about 5°, and up to about 25°. In some embodiments, the angle $\kappa 2$ is smaller than angle $\alpha$ by at least about 10°, for example, at least about 15°, and up to about 20°.

Similarly, the respective angular arms 43,44 of the second pivotable brace 40 are angled downwardly, and when the second pivotable brace 40 is in contact with the surface of the shaft 82, the angle $\lambda 1$ formed by the proximal member 45 of the angular arms 43,44 from the horizontal plane of the support frame 11, is larger than the angle $\alpha$, typically larger by about 5°, and up to about 25°. In some embodiments, the angle $\lambda 1$ is larger than angle $\alpha$ by at least about 10°, for example, at least about 15°, and up to about 20°. Conversely, the angle $\lambda 2$ formed by the distal member 46 of the angular arms 43,44 from a horizontal line perpendicular to the axis of the shaft 82, is smaller than the angle $\alpha$, typically also smaller by about 5°, and up to about 25°. In some embodiments, the angle $\lambda 2$ is smaller than angle $\alpha$ by at least about 10°, for example, at least about 15°, and up to about 20°.

The increase in the angle $\lambda_1$ of the proximal member 25 of the angular arms 23,24, and $\lambda 2$ of the of the proximal member 45 of the angular arms 43,44, is significant when the ratcheting auger bracing device 10 is used on a daily operating basis in the field. As noted in the background description, the mud and water withdrawn from a well hole in the area of ground surrounding the well hole can become deep in thick, sticky mud (M), as shown in FIG. 4, which can accumulate around the lower ends of the pivotable braces 20,40, and with time and in some circumstances, the mud M can accumulate under the proximal ends of the angular arms, and inhibit and in some cases prevent the distal end bar 28,48 from safely engaging the space between the flights of the helical blade. Consequently, use of the angular arms 23,24 and 43,44 of the embodiment of the ratcheting auger bracing device 10 provides improved operation and safety, with reduced stoppages and downtime to clear away the mud from around the auger sections and the auger bracing device.

Figure 10:
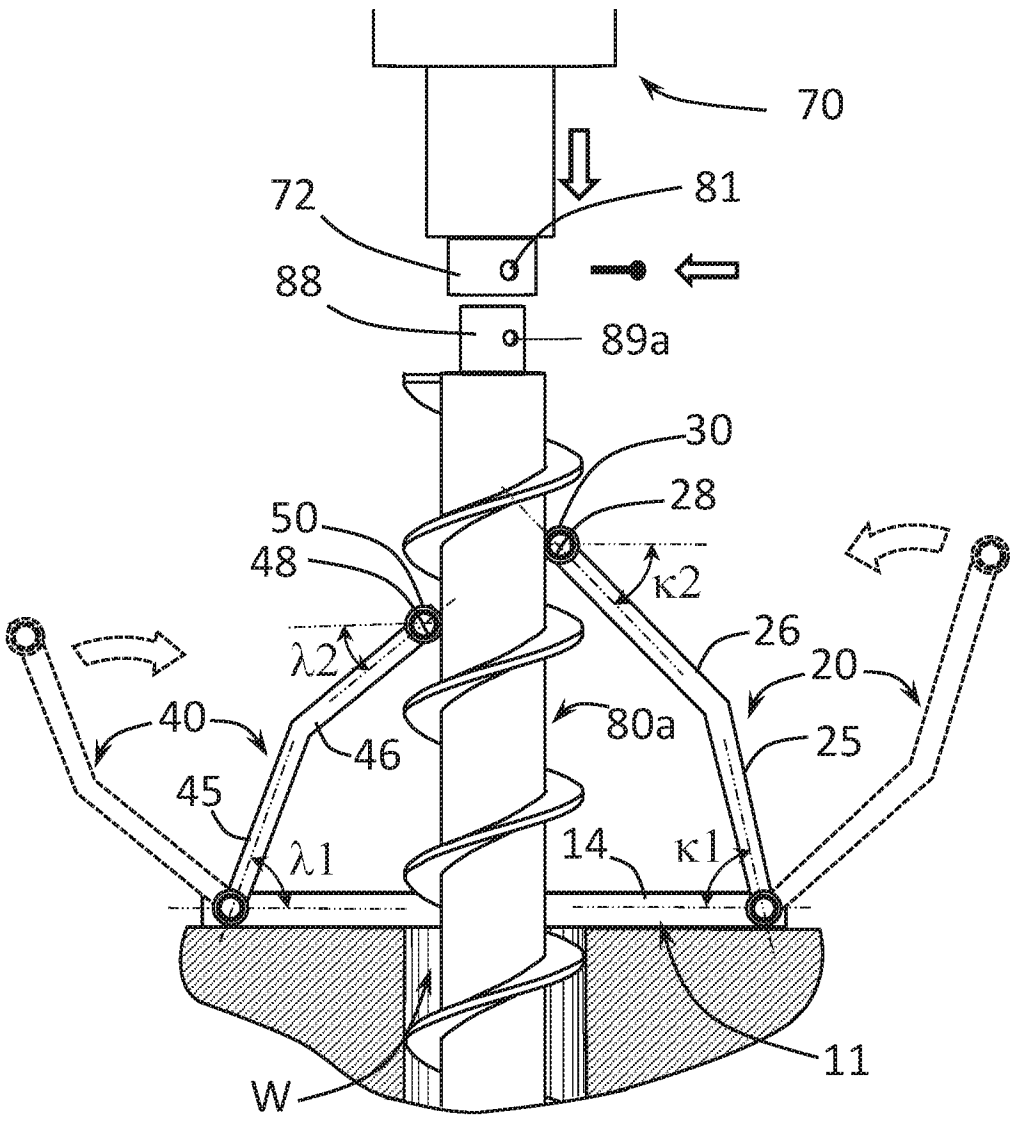
FIG. 10 illustrates a side elevation view of the ratcheting auger bracing device and auger section(s), viewed along line 10-10 of FIG. 9, also showing a drilling equipment being attached to an upper auger section.

FIGS. 9-16 illustrate the use of the ratcheting auger bracing device 10 in a drilling operation using auger sections 80 for drilling a well hole W. FIG. 9 shows an auger section 80*a* inside the upper end of a well hole W, after completion of the well hole drilling operation. Numerous in-ground auger sections are connected below the auger section 80*a* protruding from the well hole W, held in vertical position by the bottom of the well hole W itself. To commence withdrawing of the auger sections, a ratcheting auger bracing device, illustrated as the ratcheting auger bracing device 10, is opened by folding the two pivotable braces 20,40 away from the center, as shown in the dashed-line features of FIG. 10, and the support frame 11 is placed over the top and onto the ground surrounding the base of the auger section 80*a* and substantially symmetrically around the well hole W. The two pivotable braces 20,40 are then pivoted inward to engage their distal end bar 28,48 (or outer circular cylinders 30,50) with the shaft 82 of the auger section, and a drilling equipment is then attached to the post at the upper end of the upper-most auger section 80*a*, as shown in FIG. 10.

Figure 12:
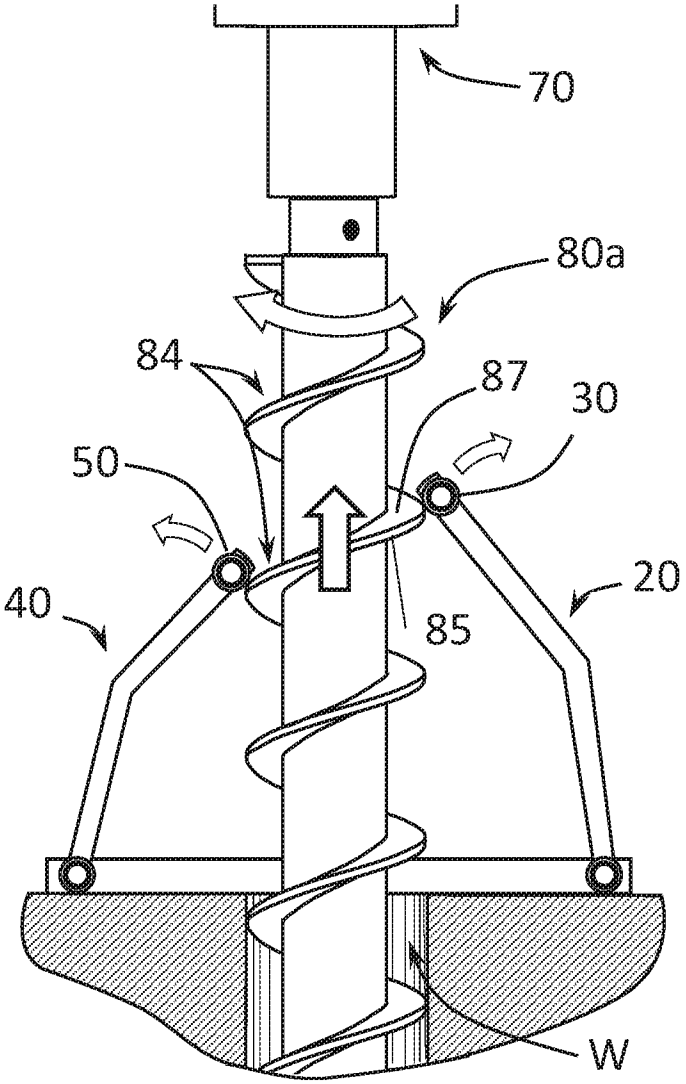
FIG. 12 illustrates the continued upper withdrawal of the upper auger section, with the pivotable braces of said ratcheting auger bracing device riding over the outer edges of the helical blades of the auger section.
Figure 11:
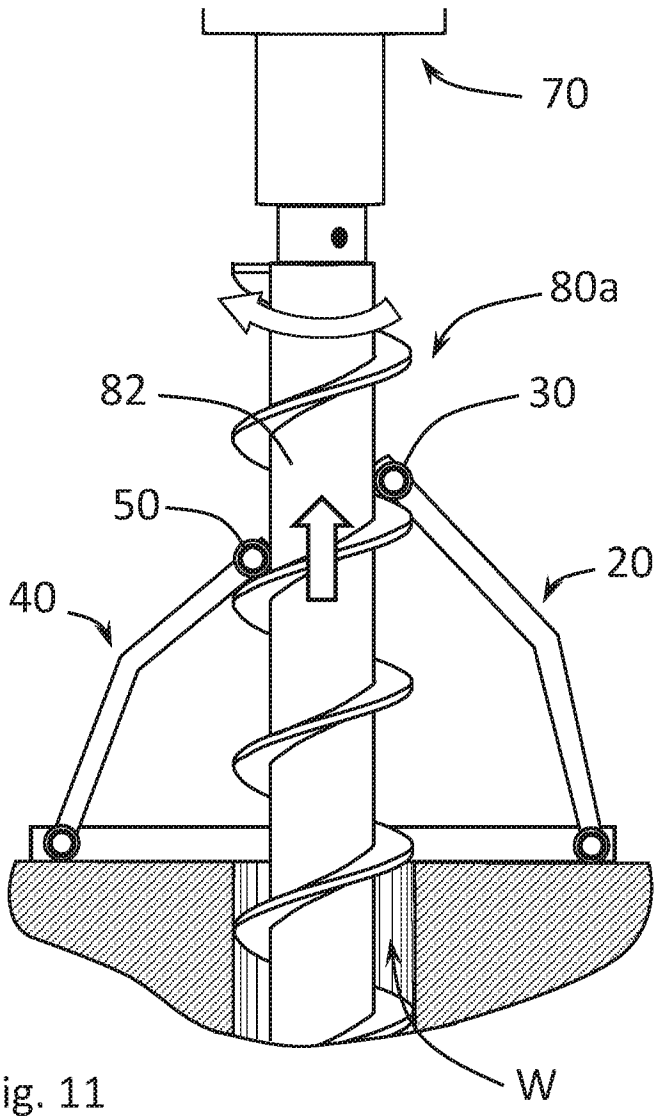
FIG. 11 illustrates the upper auger section being withdrawn up and out of the well hole, as the pivotable braces of said ratcheting auger bracing device ride along the side of the auger shaft.
Figure 13:
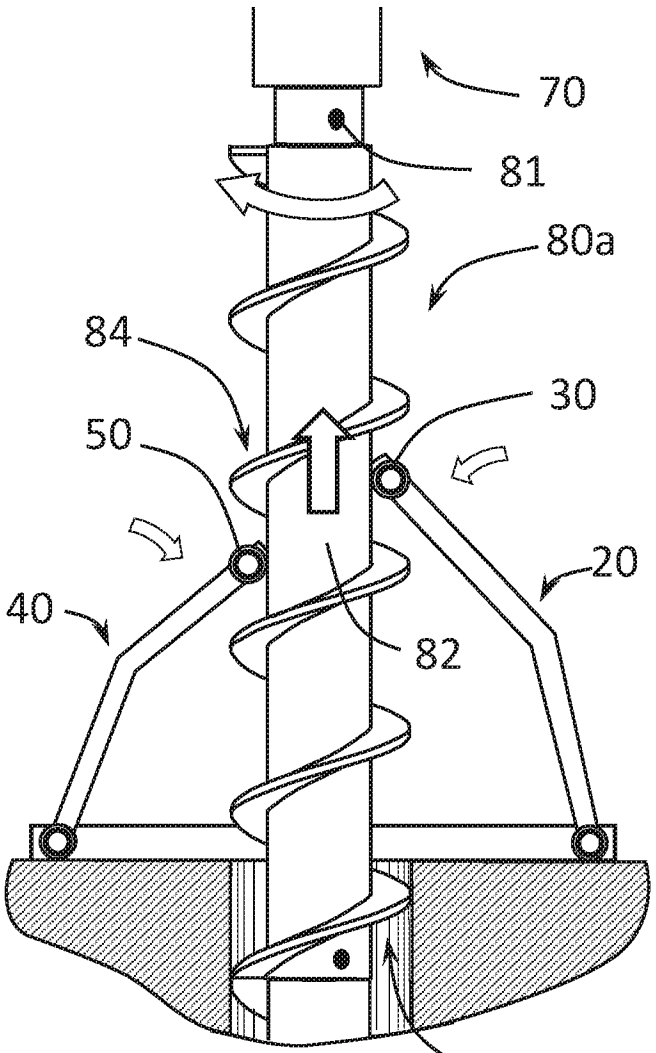
FIG. 13 illustrates the continued upper withdrawal of the upper auger section, with the pivotable braces of said ratcheting auger bracing device dropping under gravity back into contact with the shaft of the auger section beneath the helical blade.
Figure 16:
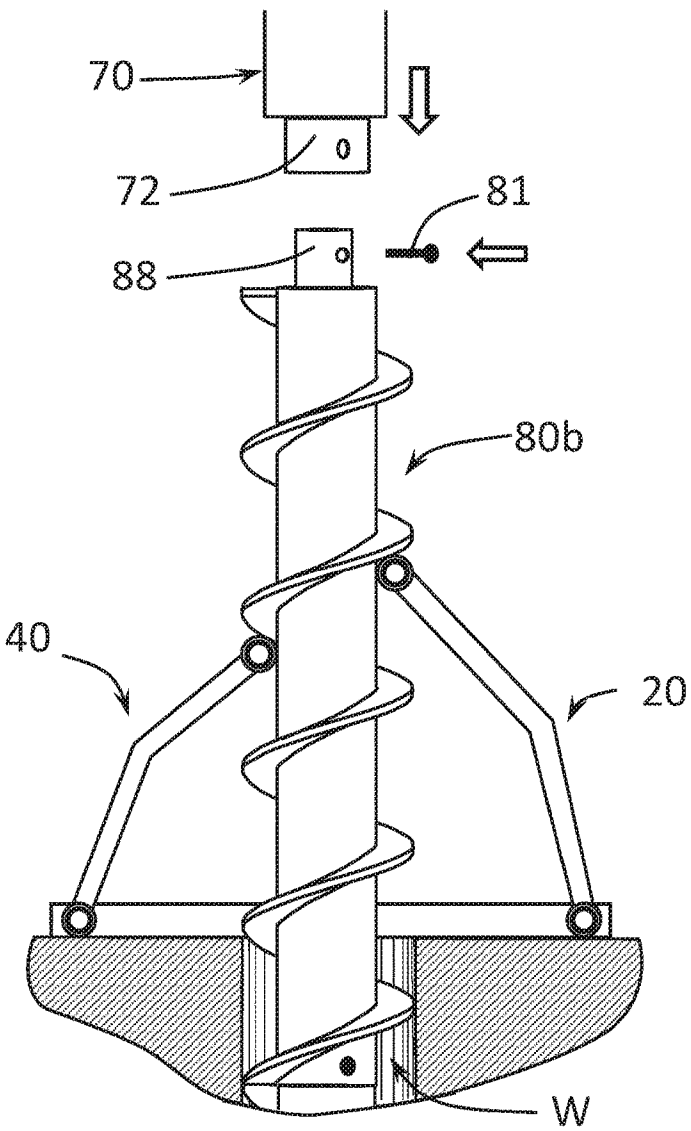
FIG. 16 illustrates the drilling equipment being reconnected to the next in-ground auger section, while said ratcheting auger bracing device supports the weight of the series of remaining in-ground auger sections.

The drilling equipment then begins to raise the lengths of auger sections out of the completed well hole W, typically while rotating the lengths of auger sections, as shown by the vertical and rotational arrows of FIGS. 11-13. As the auger sections rise, the distal end bars 28,48 of the two pivotable braces 20,40 rides down the outside surface of the shaft 82 until they encounter, substantially simultaneously, the helical blade 84, as shown in FIG. 11. As the drilling equipment continues raising the auger sections, the rising helical blade 84 forces the distal ends of the two pivotable braces 20,40 to pivot radially outwardly (small arrows), with the distal end bars 28,48 riding across the topside 87 and along the edge 85 of the helical blade 84, as shown in FIG. 12. As the auger section 80*a* continues to rise, the helical blade 84 rises above the arc of the distal end bars 28,48, which fall (pivot) by gravity radially inwardly into contact with the shaft 82, as shown in FIG. 13. The cycle of the helical blades 84 encountering the distal end bars 28,48 and pivoting the two pivotable braces 20,40 radially outwardly and back again is repeated until the upper auger section 80*a* is drawn completely out of the ground, with the next-connected auger section 80*b* now extending part-way out of the well hole W, as shown in FIG. 14.

Figure 14:
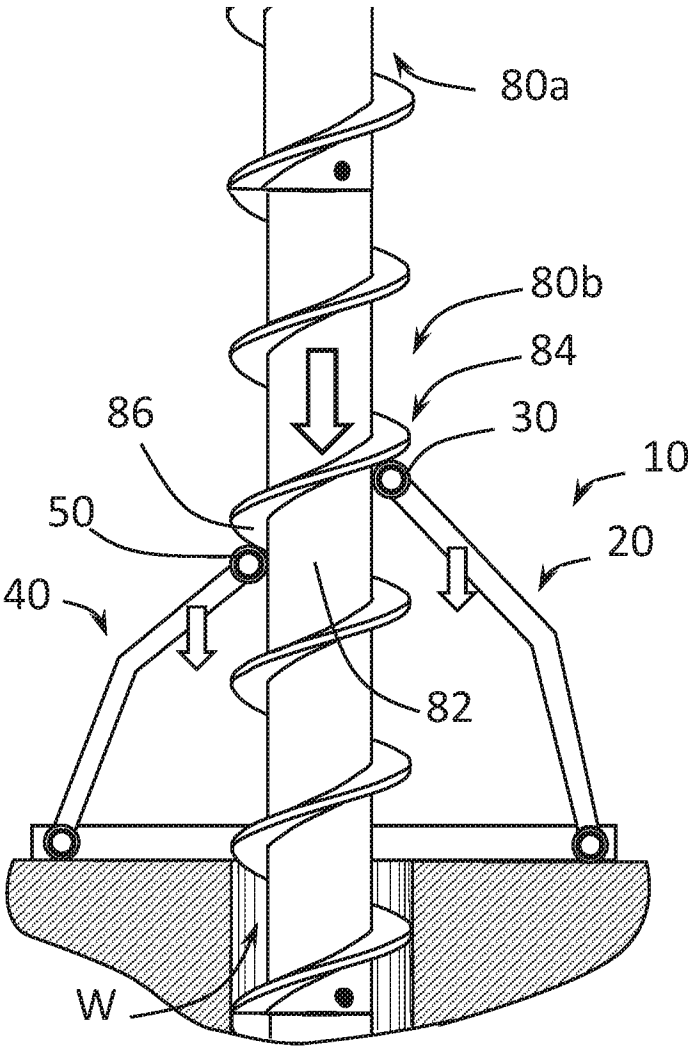
FIG. 14 illustrates the withdrawn upper auger section completely withdrawn from the well hole, and with the weight of the series of auger sections resting upon the opposed pivotable braces of said ratcheting auger bracing device positioned beneath the helical blade.
Figure 15:
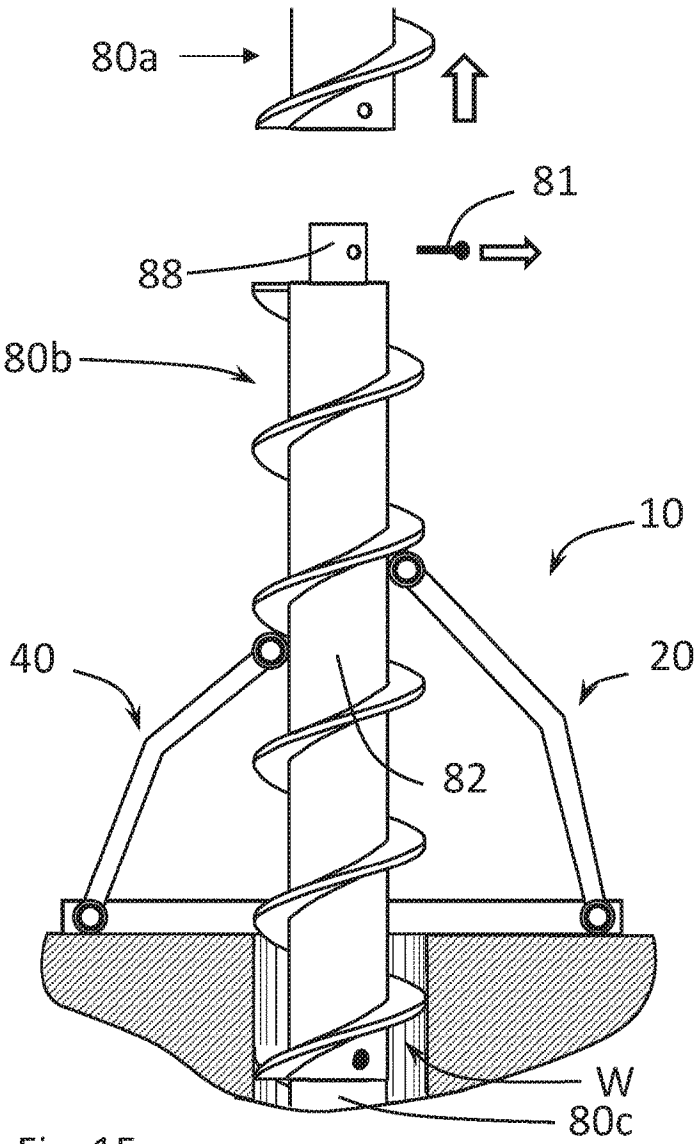
FIG. 15 illustrates the removal of the withdrawn upper auger section from the next in-ground auger section, while said ratcheting auger bracing device supports the weight of the series of remaining in-ground auger sections.

At this point, as shown in FIG. 14, the drilling equipment 70 rotation is stopped, and the weight of the lengths of auger sections 80 are lowered until the opposed distal end bars 28,48 confront the underside 86 and engage the edge 85 of the helical blade 84 of the upper-most auger section 80*b*. Thus, the entire weight of the lengths of auger sections 80 in the well hole W are supported solely by the two pivotable braces 20,40 of the ratcheting auger bracing device 10. The pin 81 that holds the upper auger section 80*a* together with the next auger section 80*b* is then unsecured and withdrawn, as shown in FIG. 15, and the drilling equipment 70 is reconnected to the post 88 at the top of the next auger section 80*b*. After securely reconnecting the drilling equipment 70, the process of rotating and raising the lengths of auger sections 80 continue, as described, removing section by section, until all the lengths of auger sections have been withdrawn from the well hole W.

The material of the support frame and pivotable braces is typically metal, and in particular is steel, aluminum, iron, or other metal or alloy, and is typically in a cylindrical form, including either a round cylinder or a square cylinder, with rigid joints secured by welding.

In another embodiment of the invention, an elevated ratcheting auger bracing device can include an elevating frame that rests upon the surface of the ground surrounding a well hole, for raising or elevating the support frame and the opposed pair of pivotable braces a distance above the ground level. The elevating frame positions the hinged ends of the pivotable braces a distance above the ground level that avoids or prevents a pooling of mud that may be raised out of the well hole and may accumulate on the ground surrounding the well hole. The raising of the hinge ends of the pivotable braces minimizes or eliminates their soiling and fowling by the accumulated mud, and increases the time and the amount of mud that can accumulate around the well hole before the need to halt the auger withdrawal process and clear away accumulated mud. In some embodiments and circumstances, the accumulated mud can be pulled away from the area around the well hole, and from within the space confined by the elevating frame, that avoids the need for halting the auger withdrawal process.

FIGS. 17-28 illustrate another set of embodiments, wherein a ratcheting auger bracing device can be elevated about the surface of the ground G. In the embodiments described, an elevating frame raises a ratcheting auger bracing device up and off the surface of the ground. An advantage thereof is to avoid, limit or minimize contact of the bracing device, and particularly the pivoting arms of the bracing device, with an accumulation of mud and slurry that can be pulled up out of a well hole, which can flood over and bind up the hinged arms of the bracing device. The elevating frame can be integrated into the support frame of the ratcheting auger bracing device, or can be a separate elevating frame upon which the ratcheting auger bracing device is placed or mounted.

Figure 17:
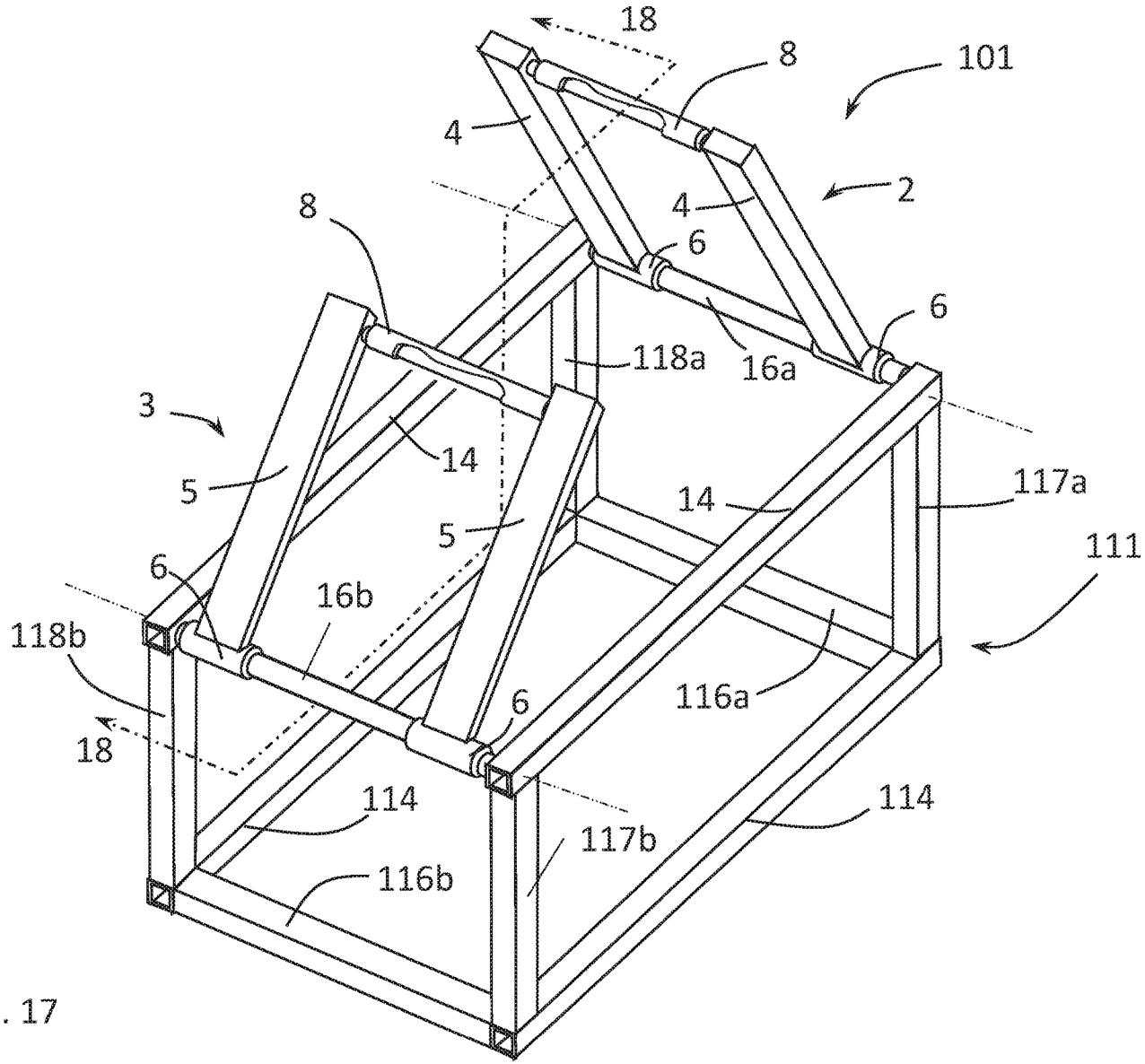
FIG. 17 illustrates a perspective view of a third embodiment of a ratcheting auger bracing device having linear-armed braces and an elevating frame.
Figure 18:
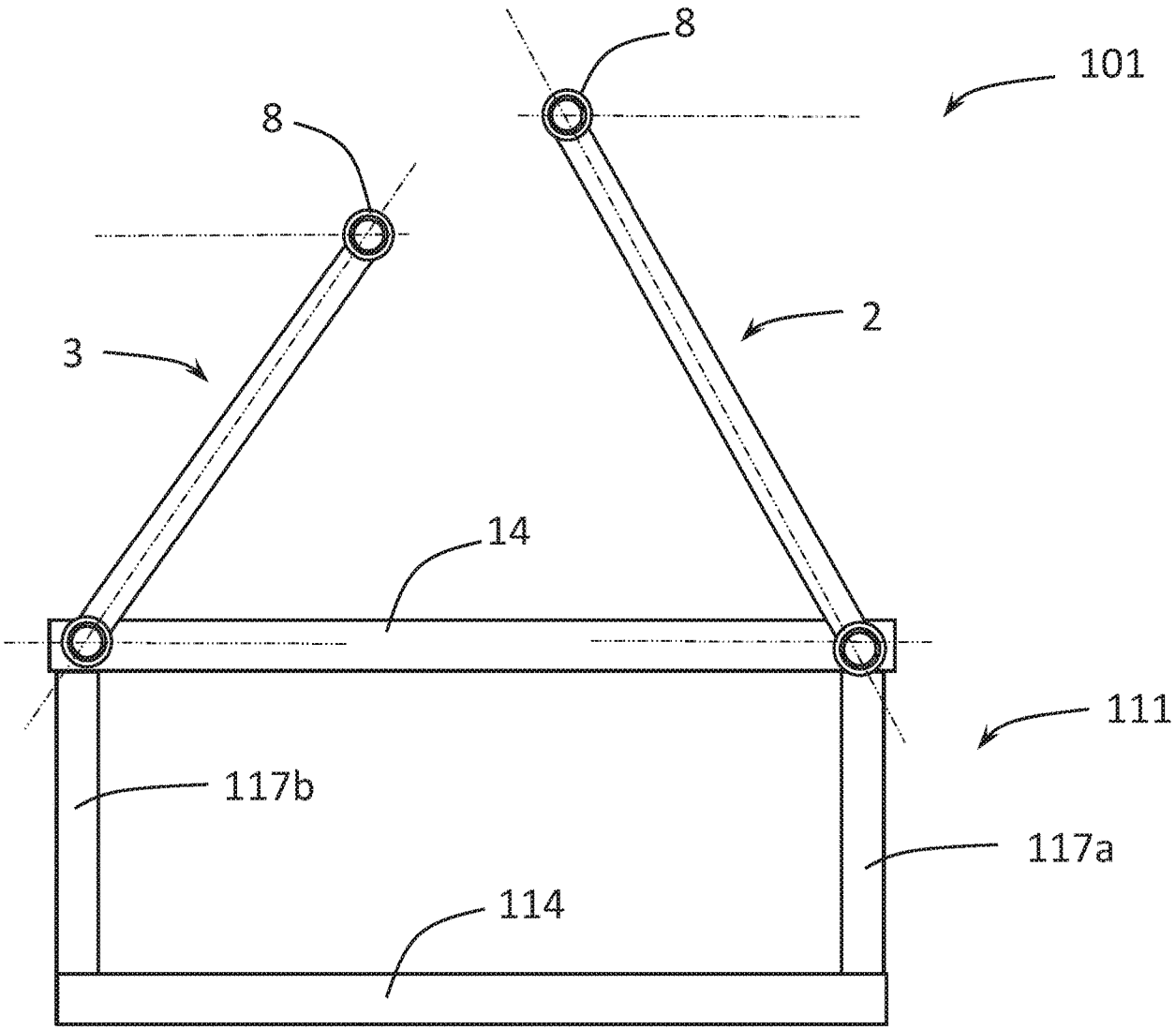
FIG. 18 illustrates a side elevation view of the ratcheting auger bracing device having the elevating frame of FIG. 17.
Figure 20:
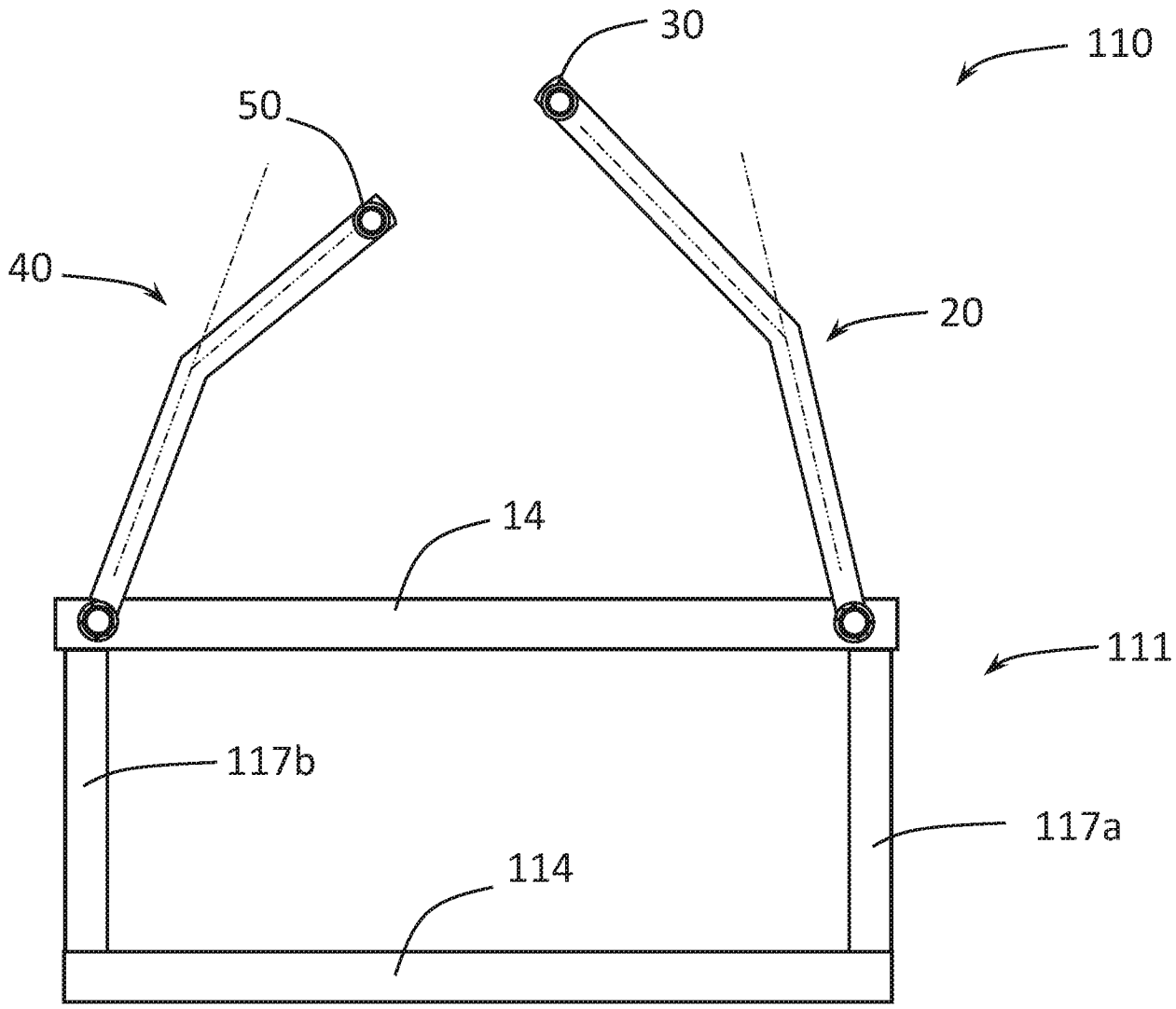
FIG. 20 illustrates a side elevation view of the ratcheting auger bracing device having the elevating frame of FIG. 19.

A third embodiment of a ratcheting auger bracing device 101 illustrated in FIGS. 17 and 18, and a fourth embodiment of a ratcheting auger bracing device 110 illustrated in FIGS. 19 and 20, further include an elevating frame 111 that is integral with the respective ratcheting auger bracing device. The elevating frame 111 includes a lower base 113 providing an interface for the elevating frame 111 upon the ground G, the lower base 113 including a pair of spaced-apart and substantially parallel, base side bars 114, including right-side bar 114*a* sand left-side bar 114*b*; a first base end bar 116*a* that connects rigidly the pair of base side bars 114 at their far, first ends, and a second base end bar 116*b* that connects rigidly the pair of base side bars 114 at their near, second ends opposite the first ends. Typically, the base sides bars 114 are rectangular cylinders, though can be of other shapes including round cylinders, and are typically, though not necessarily, similar in the size and length of the upper side bars 14. The first and second base end bars 116*a*,116*b* are rectangular cylinders, though can be of other shapes including round cylinders, and are typically, though not necessarily, similar in size and length of the upper end bars 16*a*,16*b*. In the illustrate embodiment, the lower base 113 has a rectangular shape, though other shapes having an open interior area can be used.

Figure 27:
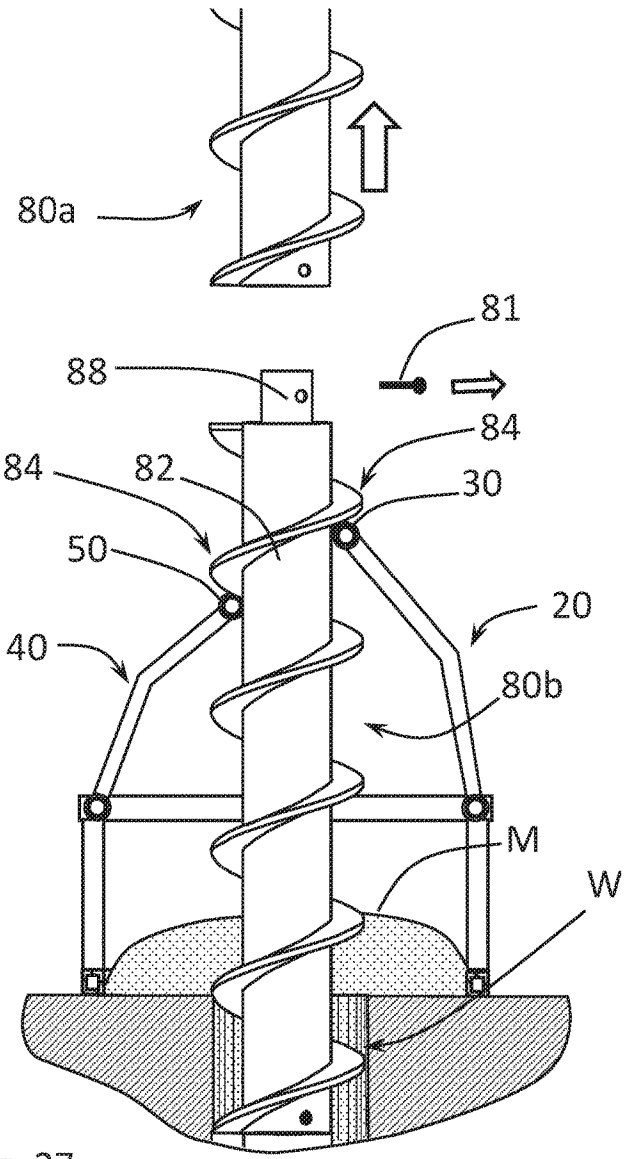
FIG. 27 illustrates the removal of the withdrawn upper auger section from the next in-ground auger section, while said ratcheting auger bracing device supports the weight of the series of remaining in-ground auger sections.

The elevating frame 111 also includes a plurality of legs that elevate the support frame 11 and the hinged pair of pivotable braces. The legs include a plurality of legs that elevate the support frame 12 above and relative to the lower base 113. in an embodiment of the invention, a first pair of upright, vertical legs 117*a* and 117*b* connects between the upper side bar 14*a* with the lower side bar 114*a*, and supports and raises the upper sides bar 14*a* above the lower side bar 114*a*. A second pair of upright, vertical legs 118*a* and 118*b* connects the opposite upper side bar 14*b* with the opposite lower side bar 114*b*, and supports and raises the upper side bar 14*b* above the lower side bar 114*b*. Typically the legs are typically vertical, though the set of legs can alternatively be diagonal between the lower base 113 and the support frame 12. In the illustrated embodiment, the vertical legs 117 and 118 are positioned at the corners formed by the respective side bars and end bars of the support frame 12 and lower base 113, The length of the vertical legs should be as long as possible to maximize the space below the pivotable braces, though the vertical legs should not be so long that limits the drilling equipment 70 from raising an uppermost auger section 80*m* well up and out of the well hole, while allowing the distal end bars, for example end bars 28 and 48 shown in FIG. 16, to engage the underside of the uppermost helical blade 84 of a next auger section 80*n*, as shown in FIG. 27.

The support frame 111 is configured in length along the side bars 14,114, and laterally along the end bars 16,116, and vertically along the vertical legs 117, 118, to provide an interior volume 112, bounded by the side bars 14,114, the end bars 16,116, and the vertical legs 117,118, that is sufficiently long, laterally broad, and vertically tall, to accommodate the full diameter of a well hole W and an auger section 80 there within, and an accumulation of mud (M) brought up out the well hole during the extraction of the lengths of auger sections 80.

In the third embodiment of a ratcheting auger bracing device, shown in FIGS. 17 and 18, the auger bracing device has a pair of opposed, hinged linear arms 2,3 upon support frame 11, elevated and supported by an elevating frame 111. The opposed, hinged linear arms 2,3, affixed pivotably to the support frame 11, as substantially as described herein above for the first embodiment of the ratcheting auger bracing device illustrated in FIGS. 5 and 6, inter alia, and as described hereinabove.

In the fourth embodiment of a ratcheting auger bracing device, shown in FIGS. 19 and 20, where the auger bracing device has a pair of opposed, angular arms 20,40 upon support frame 11, elevated and supported by an integral elevating frame 111. The opposed, angular arms 20,30, are affixed pivotably to the support frame 11, as substantially as described herein above for the first embodiment of the ratcheting auger bracing device illustrated in FIGS. 7 and 8, inter alia, and as described hereinabove.

Figure 21:
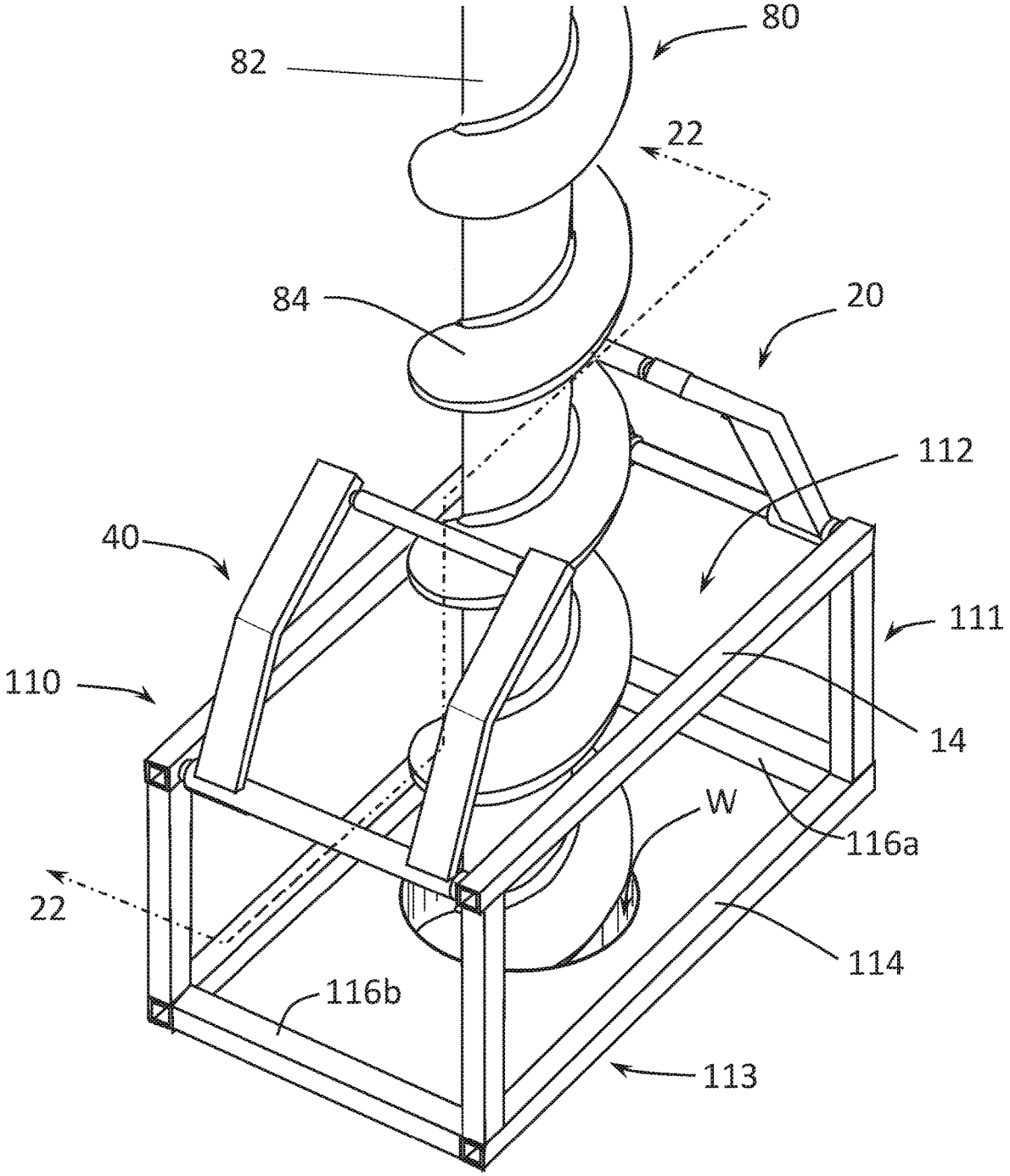
FIG. 21 illustrates a perspective view of the ratcheting auger bracing device of FIG. 19 positioned around an auger section within a well hole.

FIGS. 21-28 illustrate the use of the ratcheting auger bracing device 110 having the elevated frame 111 in a drilling operation using auger sections 80 for drilling a well hole W. FIG. 21 shows an auger section 80 inside the upper end of a well hole W, after completion of the well hole drilling operation. Numerous in-ground auger sections are connected below the auger section 80 protruding from the well hole W, held in vertical position by the bottom of the well hole W itself.

Figure 22:
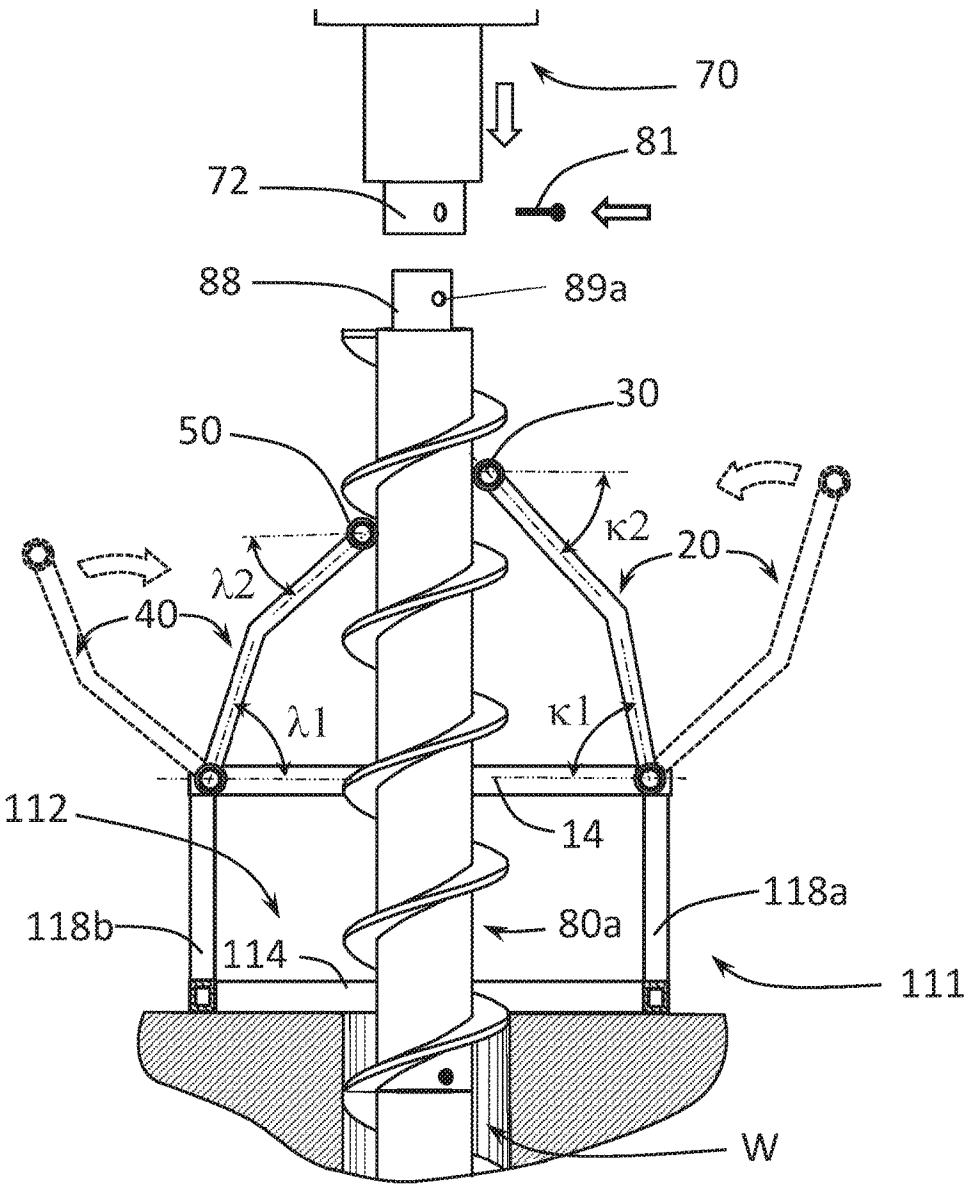
FIG. 22 illustrates a side elevation view of the ratcheting auger bracing device and auger section(s), viewed along line 22-22 of FIG. 22, also showing a drilling equipment being attached to an upper auger section.

To commence withdrawing of the auger sections, the ratcheting auger bracing device 110, is opened by folding the two pivotable braces 20,40 away from the center, as shown in the dashed-line features of FIG. 22, and the elevating support frame 111 is placed over the top and onto the ground G, as shown in FIG. 22, surrounding the base of the uppermost auger section 80*a* and substantially symmetrically around the well hole W. The drilling equipment is then attached to the post at the upper end of the upper-most auger section 80*a*, as shown in FIG. 10.

Figure 24:
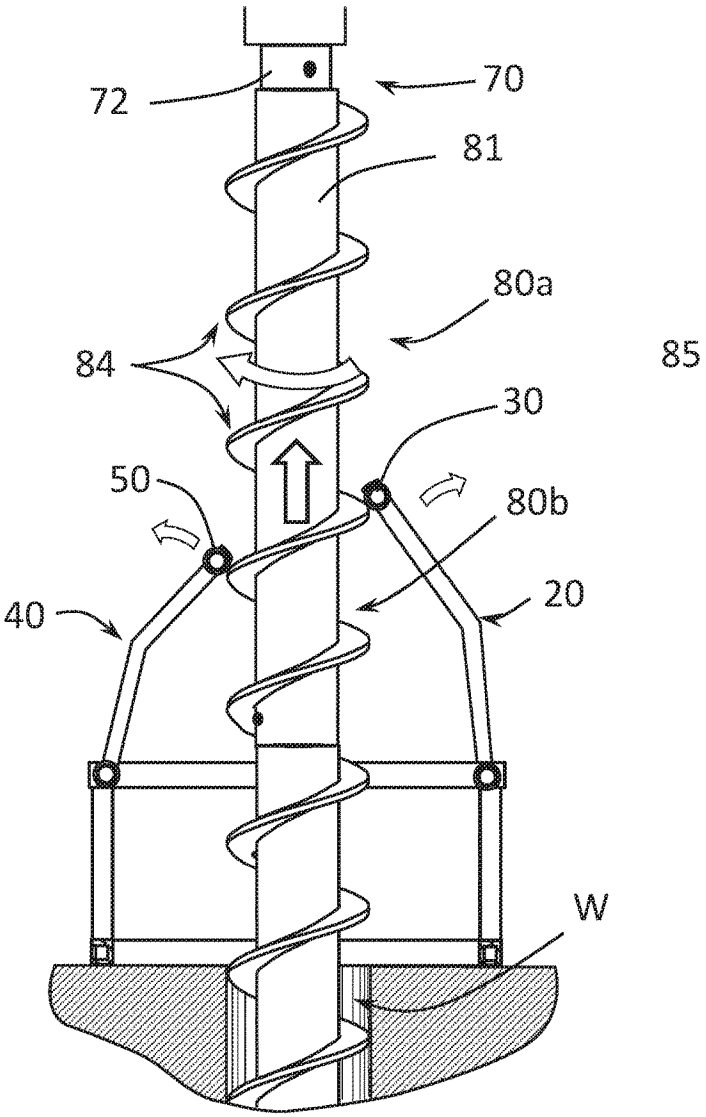
FIG. 24 illustrates the continued upper withdrawal of the upper auger section, with the pivotable braces of said ratcheting auger bracing device riding over the outer edges of the helical blades of the auger section.
Figure 23:
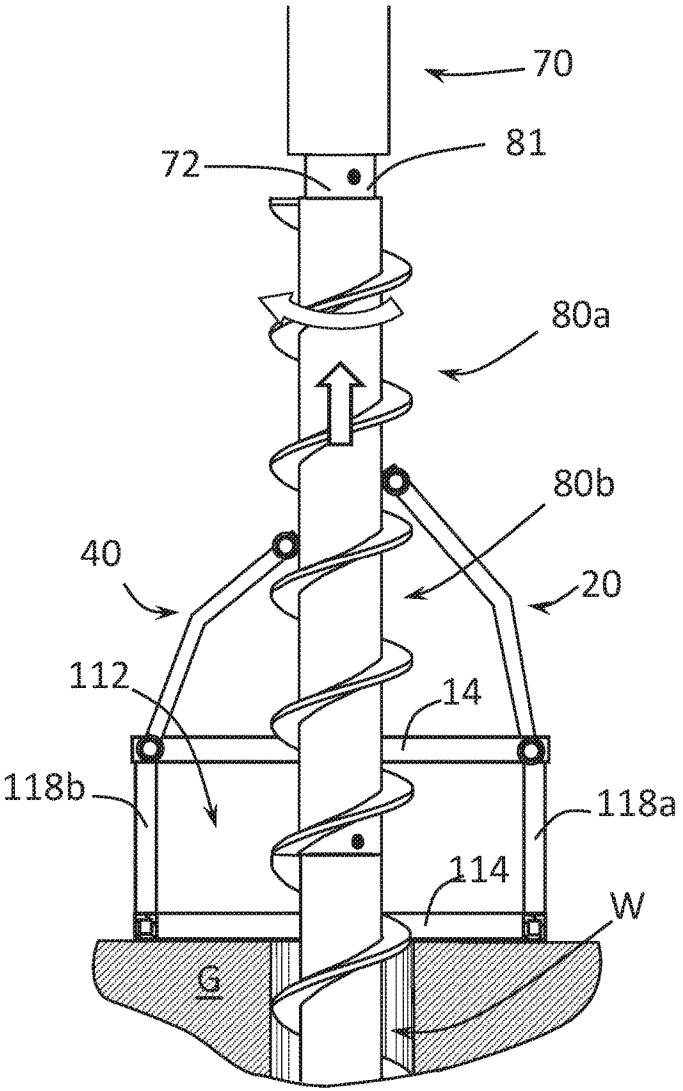
FIG. 23 illustrates the upper auger section being withdrawn up and out of the well hole, as the pivotable braces of the ratcheting auger bracing device ride along the side of the auger shaft.
Figure 25:
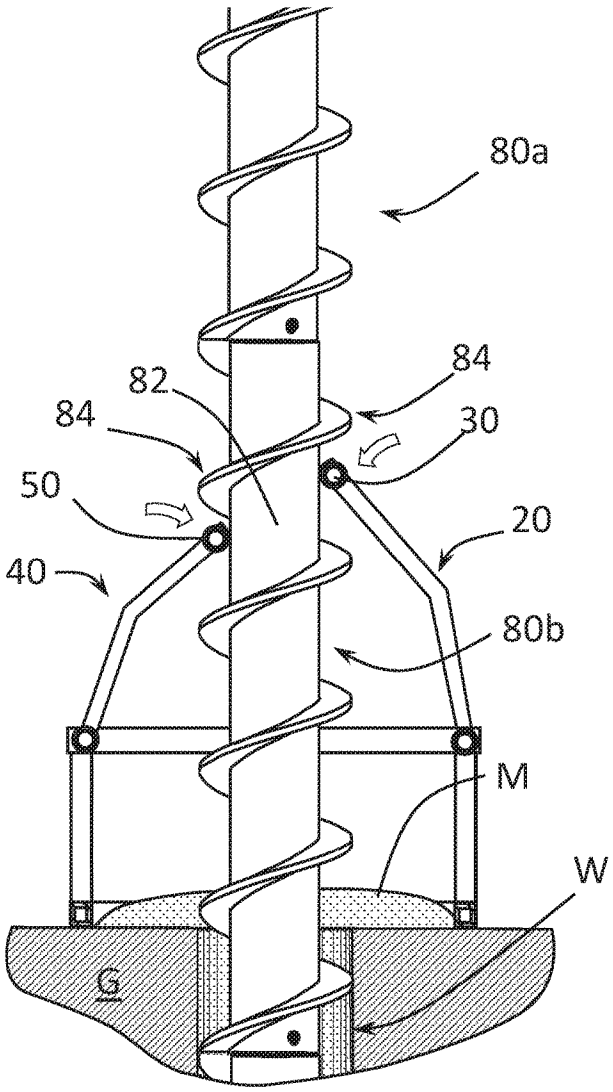
FIG. 25 illustrates the continued upper withdrawal of the upper auger section, with the pivotable braces of said ratcheting auger bracing device dropping under gravity back into contact with the shaft of the auger section beneath the helical blade.

The drilling equipment 70 then begins to raise the lengths of auger sections 80 out of the completed well hole W, typically while rotating the lengths of auger sections 80, as shown by the vertical and rotational arrows of FIG. 24. As the auger sections rise, the distal end bars 30,50 of the two pivotable braces 20,40 rides down the outside surface of the shaft 82 until they encounter, substantially simultaneously, the helical blade 84, and as the drilling equipment 70 continues raising the auger sections 80, the rising helical blade 84 forces the distal ends 30,50 of the two pivotable braces 20,40, respectively, to pivot radially outwardly (small arrows in FIG. 24), with the distal end bars 30,50 riding along the edge 85 of the helical blade 84, as shown in FIG. 24. As the auger section 80*a* continues to rise, the helical blade 84 rises above the arc of the distal end bars 30,50, which fall (pivot) by gravity radially inwardly into contact with the shaft 82, small arrows, as shown in FIG. 25. The cycle of the helical blades 84 encountering the distal end bars 30,50 and pivoting the two pivotable braces 20,40 radially outwardly and back again has been repeated for the remained of helical blades 84 of the auger section 80*a* until the upper auger section 80*a* is drawn completely out of the ground, with the next-connected auger section 80*b* now extending part-way out of the well hole W, as shown in FIG. 25.

Figure 26:
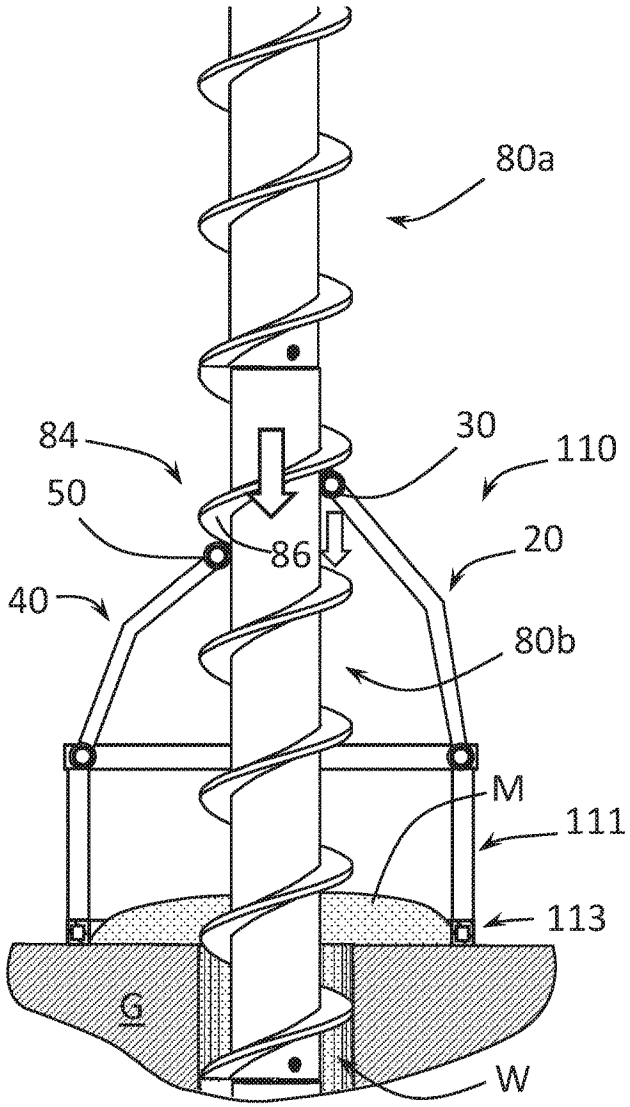
FIG. 26 illustrates the withdrawn upper auger section completely withdrawn from the well hole, and with the weight of the series of auger sections resting upon the opposed pivotable braces of said ratcheting auger bracing device positioned beneath the helical blade.
Figure 28:
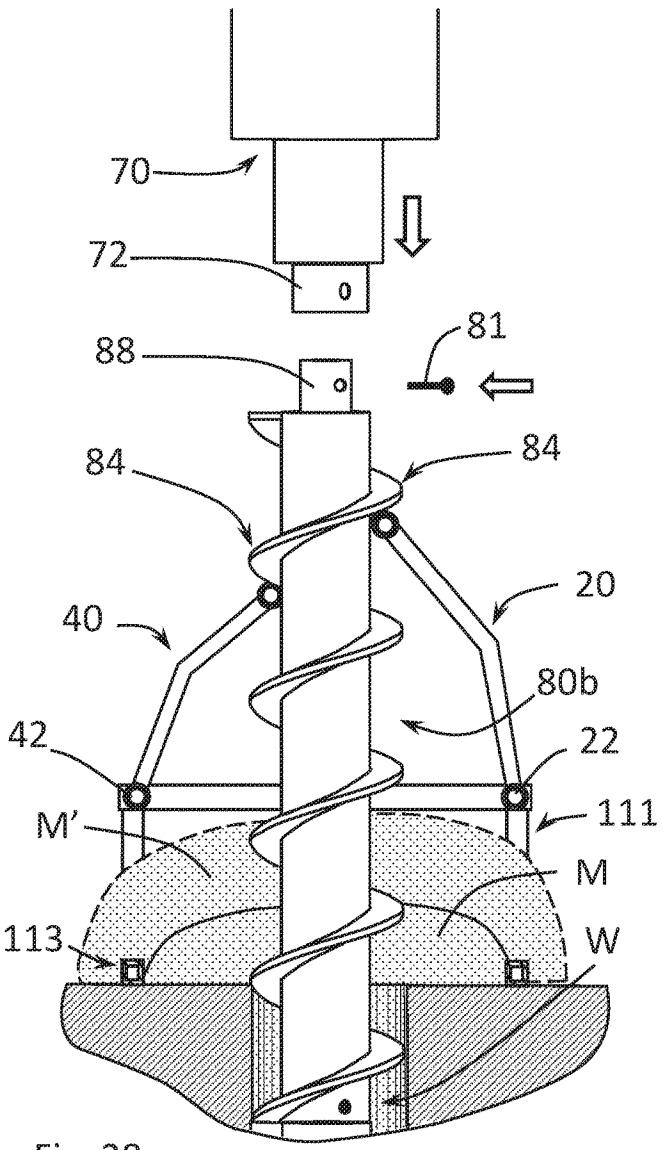
FIG. 28 illustrates the drilling equipment being reconnected to the next in-ground auger section, while said ratcheting auger bracing device supports the weight of the series of remaining in-ground auger sections.

At this point, as shown in FIG. 26, the drilling equipment 70 rotation is stopped, and the weight of the lengths of auger sections 80 are lowered until the opposed distal end bars 30,50 confront from the underside 86 and engage the edge 85 of the helical blade 84 of the upper-most auger section 80*b*. Thus, the entire weight of the lengths of auger sections 80 in the well hole W are supported solely by the two pivotable braces 20,40 of the ratcheting auger bracing device 110. The pin 81 that holds the upper auger section 80*a* together with the next auger section 80*b* is then unsecured and withdrawn, as shown in FIG. 27. After the drilling equipment is uncoupled from the upper auger section 80*a* (not shown), the drilling equipment 70 is reconnected to the post 88 at the top of the next auger section 80*b*, as shown in FIG. 28. After securely reconnecting the drilling equipment 70, the process of rotating and raising the lengths of auger sections 80 continue, as described, removing section by section, until all the lengths of auger sections have been withdrawn from the well hole W.

FIGS. 25-28 also illustrate that the withdrawal of auger sections 80 from the well hole W results in the expulsion of mud M from within the well hole W, onto the ground G surrounding the well hole and within the volume space of the elevating frame 111. The amount of mud M initially might be very little, but as length after length of auger sections 80 are pulled out, disconnected, and the drilling equipment reconnected to the next auger section, the accumulation of mud M increases. It should be understood that the elevating of the pivoting ends 22,42 of the respective brace arms 20,40 will avoid even a very large amount of mud, illustrated by mud M' in FIG. 28, from contacting the pivoting ends 22,42, despite the mud M' flowing outward from and beyond the sides 114 and ends 116*a*,116*b* of the lower, elevating base 113 of the elevating frame 111, through the openings in the elevating frame 111 between the base sides 114 of the elevating base 113 and side bars 14 of the support frame 11, and the base ends 116 of the elevating base 113 and the end bars 16 of the support frame 11.

Figure 29:
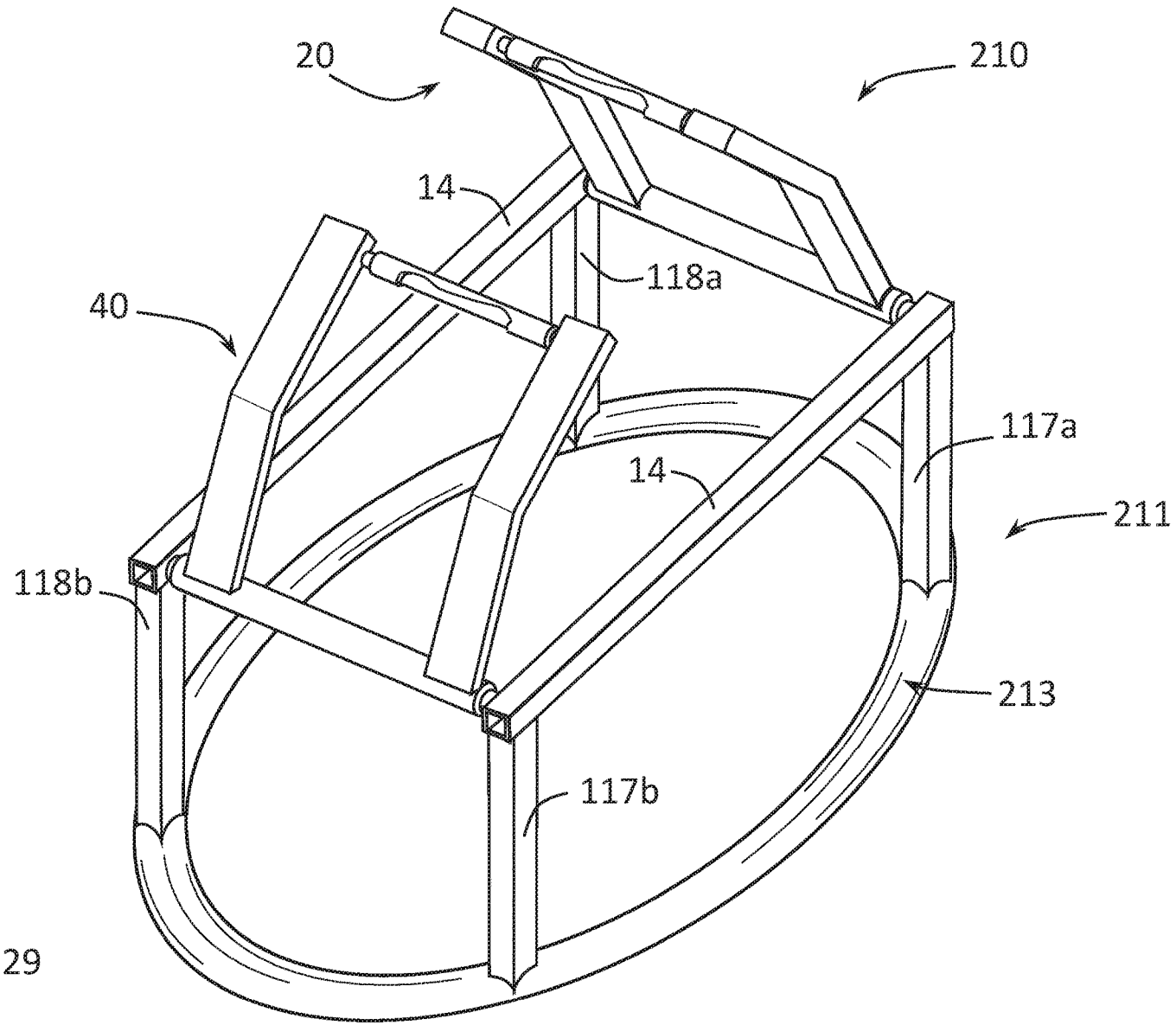
FIG. 29 illustrates a ratcheting auger bracing device having an oval-shaped peripheral tubular assembly.

FIG. 29 illustrates an embodiment, which may be used in combination with any other embodiment described herein, wherein the peripheral tubular assembly includes a tubular member in the shape of an oval, illustrated in FIG. 29 as tubular member 213, from which extends the first pair of upright, vertical legs 117*a* and 117*b* and the second pair of upright, vertical legs 118*a* and 118*b*, for example.

FIG. 30-35 illustrate another set of embodiments, wherein a ratcheting auger bracing device can be elevated about the surface of the ground G by a separate elevating frame. The separate elevating frame can be configured to provide securement features that will prevent the mounted ratcheting auger bracing device from sliding off the upper support surface of the elevating frame during its use. Other embodiments can include securement means, such as pins, fasteners or clamps, to secure the ratcheting auger bracing device to the separate elevating frame.

Figure 30:
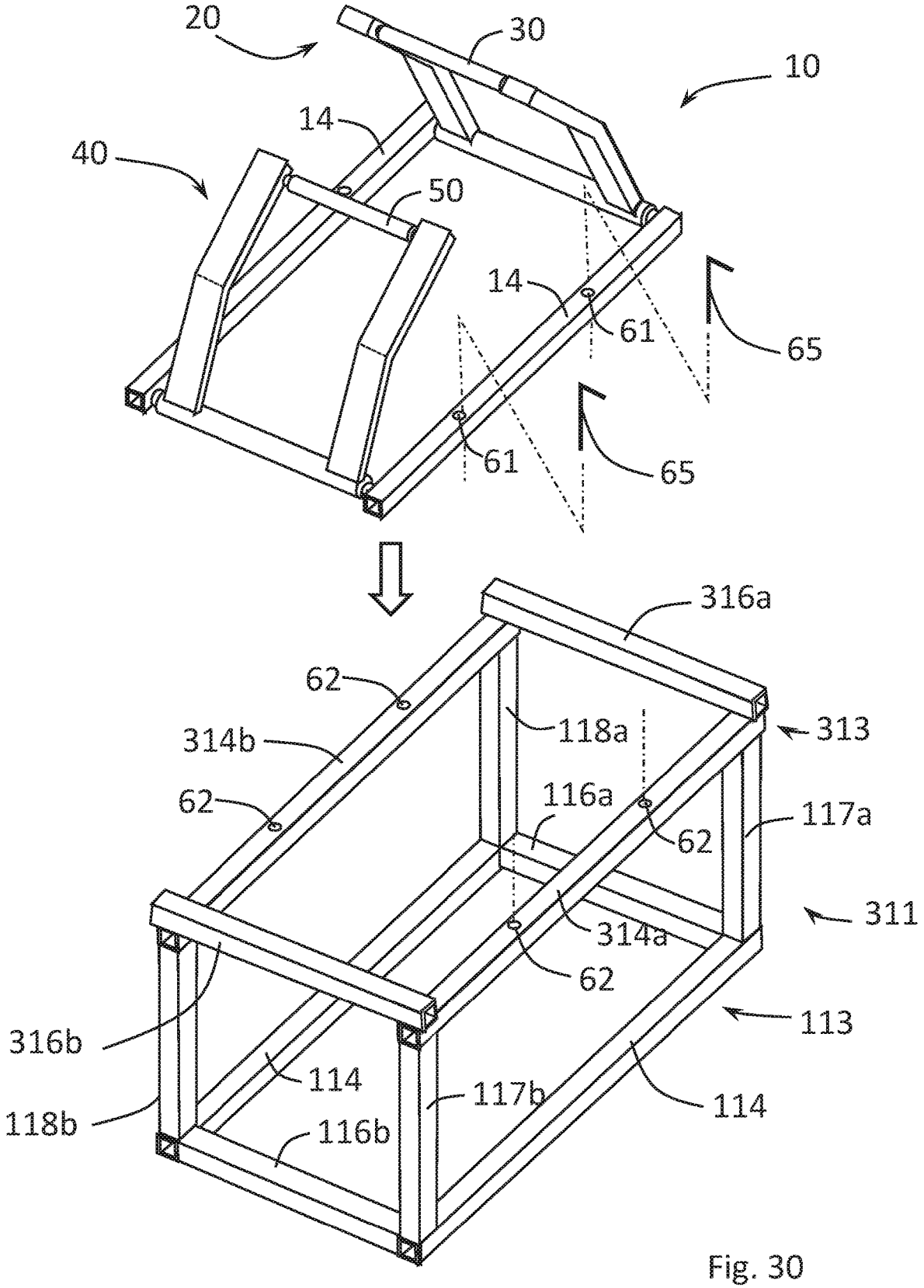
FIG. 30 illustrates a separate elevating frame for use with a ratcheting auger bracing device to raise the bracing device above the ground surface.

FIG. 30 illustrates a separate elevating frame 311 having a lower base 113 that provides an interface upon the ground G, and an upper base 313. The lower base 113 includes a pair of spaced-apart and substantially parallel, base side bars 114*a*,114, a first base end bar 116*a* that connects rigidly the pair of base side bars 114*a*,114*b* at their far, first ends, and a second base end bar 116*b* that connects rigidly the pair of base side bars 114*a*,114*b* at their near, second ends opposite the first ends. The upper base 313 includes a pair of spaced-apart and substantially parallel, base side bars 314*a*, 314*b*, a first base end bar 316*a* that connects rigidly the pair of base side bars 314*a*,314*b* at their far, first ends, and a second base end bar 316*b* that connects rigidly the pair of base side bars 314*a*,314*b* at their near, second ends opposite the first ends. In the illustrated embodiment, each of the first base end bar 316*a* and the second base end bar 316*b* are fixed to rest on top of the base side bars 314*a*,314*b*, and more specifically, that undersides of the opposed ends of the first and second base end bars 316*a*,316*b*, are placed and secured on the upper sides of the respective opposed ends of the first and second base end bars 316*a*,316*b*. The Typically, the base sides bars 114 and the end bars 116 are rectangular cylinders, though can be of other shapes including round cylinders, and are typically, though not necessarily, similar in the size and length of the upper side bars 314 and upper end bars 316. In the illustrate embodiment, the lower base 113 and the upper base 313 have a rectangular shape or footprint on the ground, though other shapes having an open interior area can be used.

Figure 31:
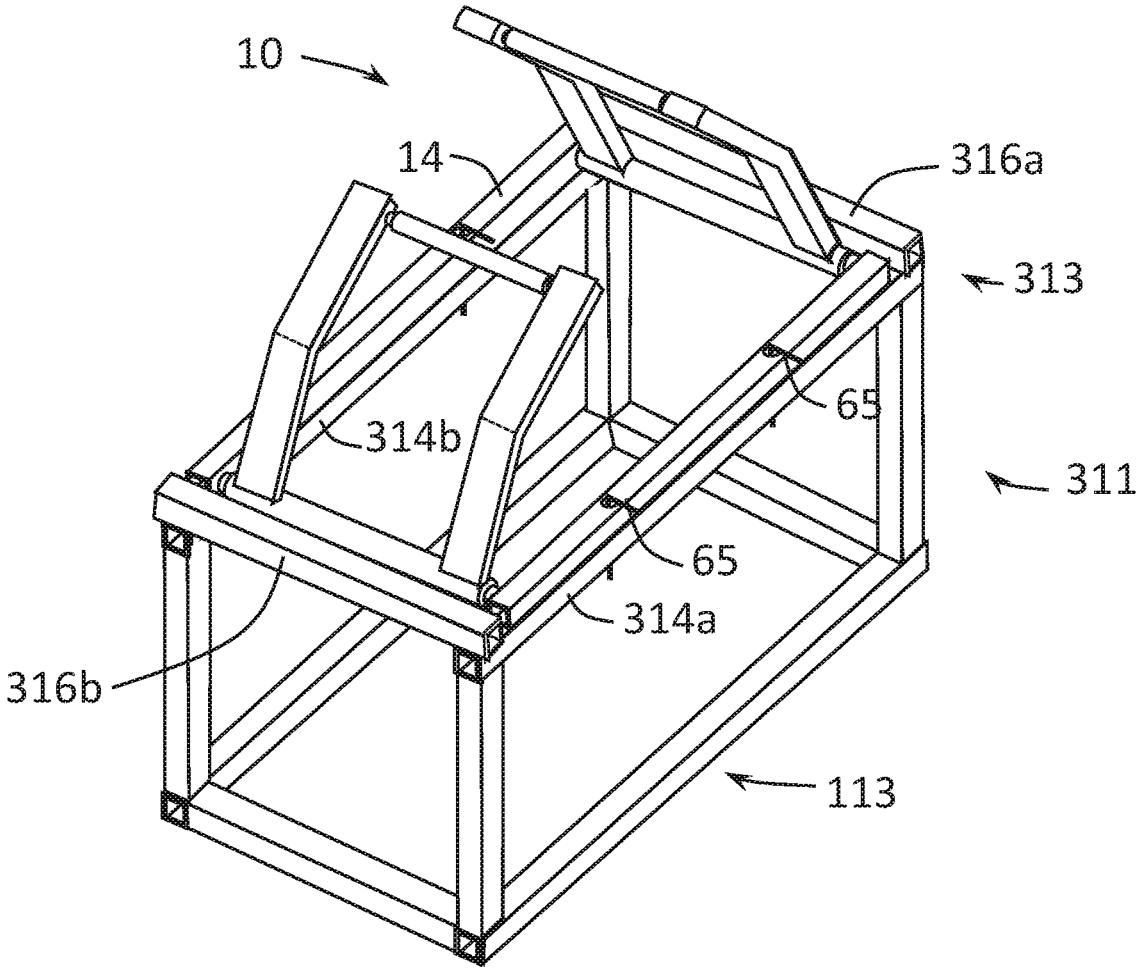
FIG. 31 illustrates the ratcheting auger bracing device mounted upon the separate elevating frame of the FIG. 30.

As shown in FIGS. 30 and 31, the bracing device 10 can be position above the separate elevating frame 311 after the frame 311 is position around the well hole and the protruding lengths of auger sections 80 (as shown by example in FIG. 21), and then placed down onto the upper surface of the elevating frame 311. The pair of side bars 14 of the support frame 11 are placed on top of the respective base sides 114 of the elevating base 113, with the opposed ends of the side bars 14 confronting and confined by the transverse first and second base end bars 316*a* and 316*b*, to prevent horizontal movement of the support frame 11 relative to the elevating frame 311 in the longitudinal direction (along the length parallel with the side bars 14).

The separate elevating frame 311 also includes a plurality of legs that elevate the support frame 12 above and relative to the lower base 113, and elevate the support frame 11 of the ratcheting auger bracing device 10. An example of such upright, vertical legs is shown and described in FIG. 17. Typically the legs are vertical, though the set of legs can alternatively be diagonal between the lower base 113 and the support frame 12. In the illustrated embodiment, the vertical legs 117 and 118 are positioned at the corners formed by the respective side bars and end bars of the lower base 113 and the upper base 313. The length of the vertical legs should be as long as possible to maximize the space below the pivotable braces of the ratcheting auger bracing device 10, though the vertical legs should not be so long that limits the drilling equipment 70 from raising an uppermost auger section 80*m* well up and out of the well hole, while allowing the distal end bars of the opposed arms of the pivotable braces, for example end bars 30 and 50 shown in FIG. 30, to engage the underside of the uppermost helical blade 84 of a next auger section 80*n*, as illustrated in FIG. 27.

An embodiment can also include a means for preventing horizontal movement of the support frame 11 relative to the elevating frame 311 in the lateral direction (side to side), transverse to the length parallel with the side bars 14. One such means can include a pin 65 that is inserted through a through hole 61 in the side bar 14, and through a through hole 62 in the base sides bars 114 that align with the through hole 61 in the side bar 14. Typically two or more pairs of aligned holes 61,62 and respective pins 65 are used in each side bar 14 and base side bar 314.

Figure 32:
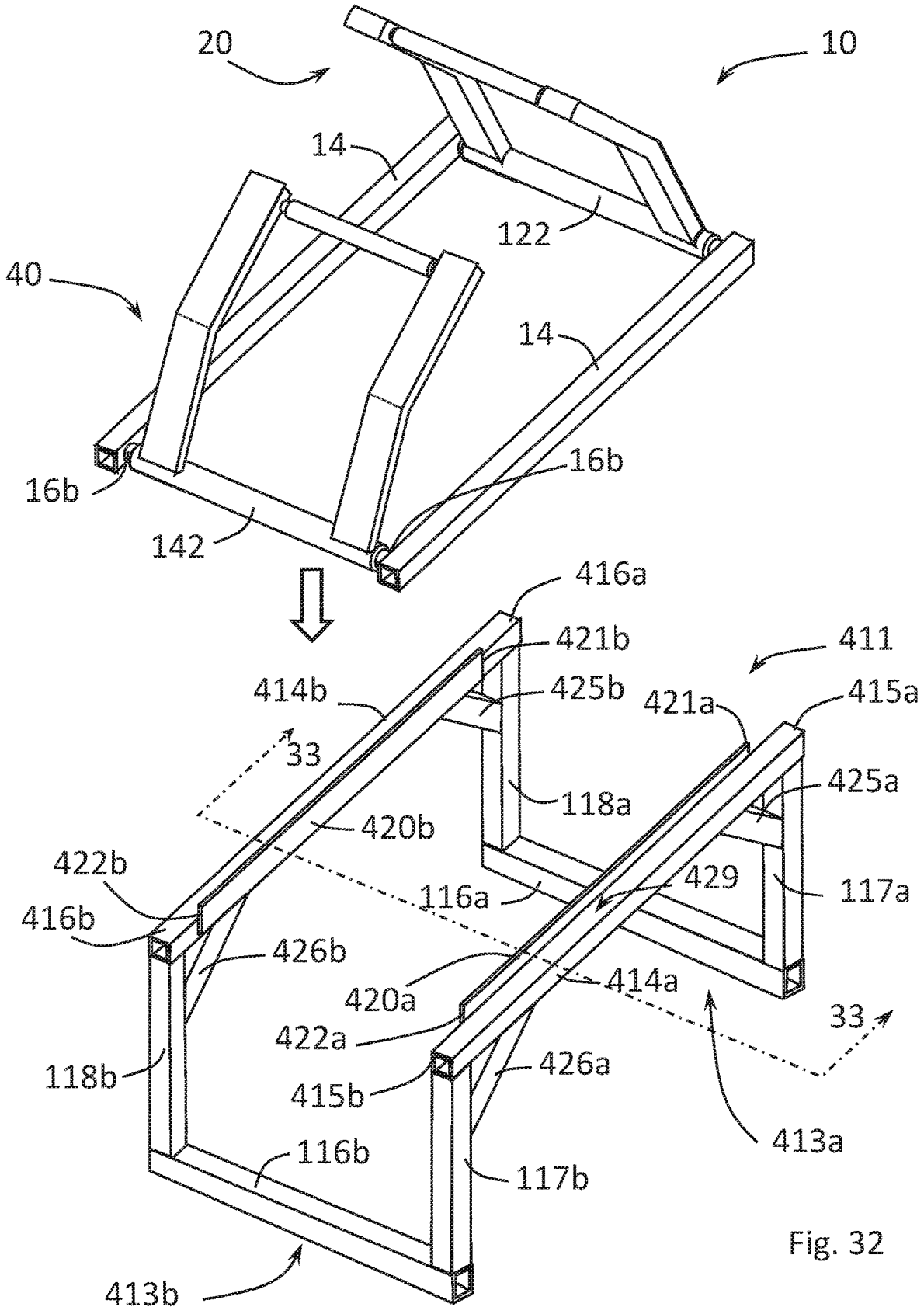
FIG. 32 illustrates a second embodiment of a separate elevating frame for use with a ratcheting auger bracing device to raise the bracing device above the ground surface.

Another means for preventing horizontal movement in the lateral direction can be a one or more raised wall sections secured to either the inner side surface of the base side bars 314, or the outer side surface of the base side bars 314, that extend vertically above the upper surface of the base side bars 314. FIG. 32 shows in another embodiment to be described, an pair of elongated walls 420*a* and 420*b* secured to the inner side surface of the base side bars (base side bars 414*a* and 414*b* in FIG. 32), which extend vertically above the upper surfaces of the base side bars. It can be understood that two or more raised wall sections can be secured to the base side bars, spaced apart by some distance. The lengths and heights of the raised wall sections can be selected to ensure restraining of the lateral, horizontal movement, and to prevent the side bars 14 from too easily "jumping" over the raised wall sections. In another embodiment, such raised wall sections can be secured the outer side surface of the base side bars 314.

In another embodiments, a means for preventing horizontal movement can include a fastener, such as a threaded bolt, cotter pin, or other fastener to not only prevent lateral (or longitudinal) horizontal movement, but also to fix the bracing device to a separate elevating frame, to prevent lifting of the bracing device off of the elevating frame, and form a unified elevated bracing device. This arrangement allows for the two separate devices—the bracing device and the elevating frame—to be handled separately, yet secured together into one unit.

FIG. 32 illustrates another embodiment of a separate elevating frame 411 having a pair of opposed lower bases 413*a* and 413*b* that provide an interface upon the ground G, and an upper base assembly 413. The lower bases 113 413*a*,413*b* consist of the first base end bar 316*a* and the second base end bar 316*b* which are spaced apart and parallel to one another, and support the upper base assembly 413 through the plurality of upright, vertical legs 117*a*,118*a* and 117*b*,118*b*. The upper base assembly 413 comprises a first base side bar 414*a*, supported by legs 117*a* and 117*b*, and a second side bar 414*b*, supported by legs 118*a* and 118*b*. To improve stability, especially movement of the upper base assembly 413 in the horizontal, longitudinal direction, diagonal braces 425*a* and 426*a* are fixed on opposite sides of the first base side bar 414*a* and connected along the length of the opposite vertical legs 117*a* and 117*b*, and diagonal braces 425*b* and 426*b* are fixed on opposite sides of the second side bar 414*b* and connected along the length of the opposite vertical legs 118*a* and 118*b*. One advantage of the separate elevating frame 411 is the absence of any longitudinal base side bars extending along the ground G, between the upright vertical legs 117*a*,117*b* and 118*a*,118*b*, respectively, which may interfere with efforts to pull accumulated mud M from around the well hole and out the sides of the elevating frame 411.

The elevating frame 411 also includes a means for preventing horizontal movement of the support frame 11, after mounting the support frame 11 upon the elevating frame 411, in both the longitudinal direction and the lateral direction. One or more raised wall sections can be secured to either the inner side surface of the base side bars 414, or the outer side surface of the base side bars 414, that extend vertically above the upper surface of the base side bars 414.

A pair of elongated walls 420*a* and 420*b* secured to the inner side surface of the base side bars 414*a*,414*b* extend vertically above the upper surfaces of the base side bars. It can be understood that two or more raised wall sections can be secured to the base side bars, spaced apart by some distance. The lengths and heights of the raised wall sections can be selected to ensure restraining of the lateral, horizontal movement, and to prevent the side bars 14 from too easily "jumping" over the raised wall sections.

In addition, the raised end edges 421*a* and 422*a* at opposite ends of the first elongated wall 420*a* are position longitudinally inward from the ends 415*a*,415*b* of the first base side bars 414*a*, and the raised end edges 421*b* and 422*b* at opposite ends of the second elongated wall 420*b*, are position longitudinally inward from the ends 416*a*,416*b* of the second base side bar 414*b*. These raised end edges 421,422 are configured to contact the interior sides of the lateral base end bars 16*a*,16*b* of the or bracing device 10, which is illustrated in FIG. 35 where thereby preventing restricting longitudinal movement of the bracing device 10.

In other embodiments, the elongated walls 420 can be secured to the outer side surface of the base side bars 414, or on both the inner side surface and the outer side surface of the base side bars 414.

Figure 33:
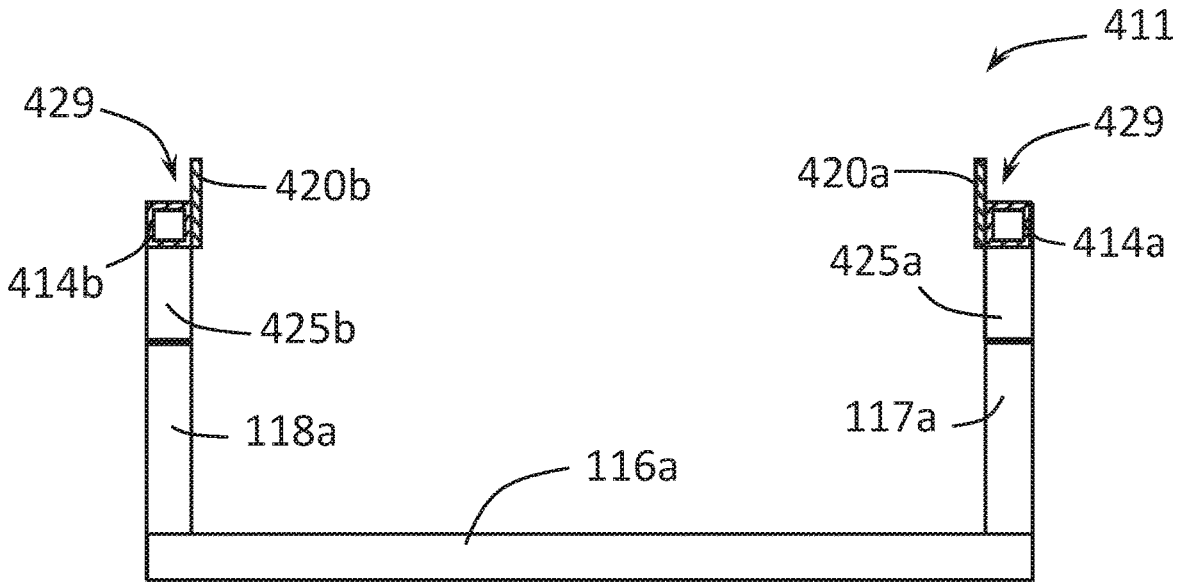
FIG. 33 illustrates a vertical sectional view of the separate elevating frame of FIG. 32, taking along line 33-33.
Figure 34:
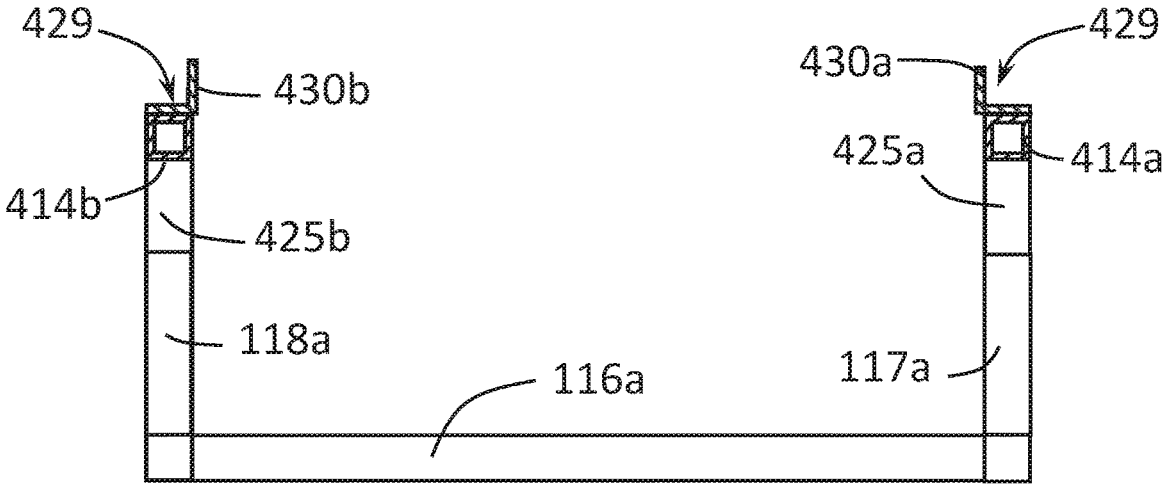
FIG. 34 illustrates a vertical sectional view of an alternative embodiment of a separate elevating frame, similar to the elevating frame shown in FIG. 32.

FIG. 33 shows a vertical sectional view of the elevating frame 411, showing the elongated walls 420*a*,420*b* secured to the inner side surface of the respective base side bars 414*a*,414*b*. The fixture of the elongated wall 420 to the base side bar 414 provides a crease 429 that can retain the side bar 14 of the bracing device 10. FIG. 34 shows an alternative embodiment, wherein a single L-shaped member 430 is secured to the tops of the vertical legs 117,118, in place of the base side bars and elongated wall.

Figure 35:
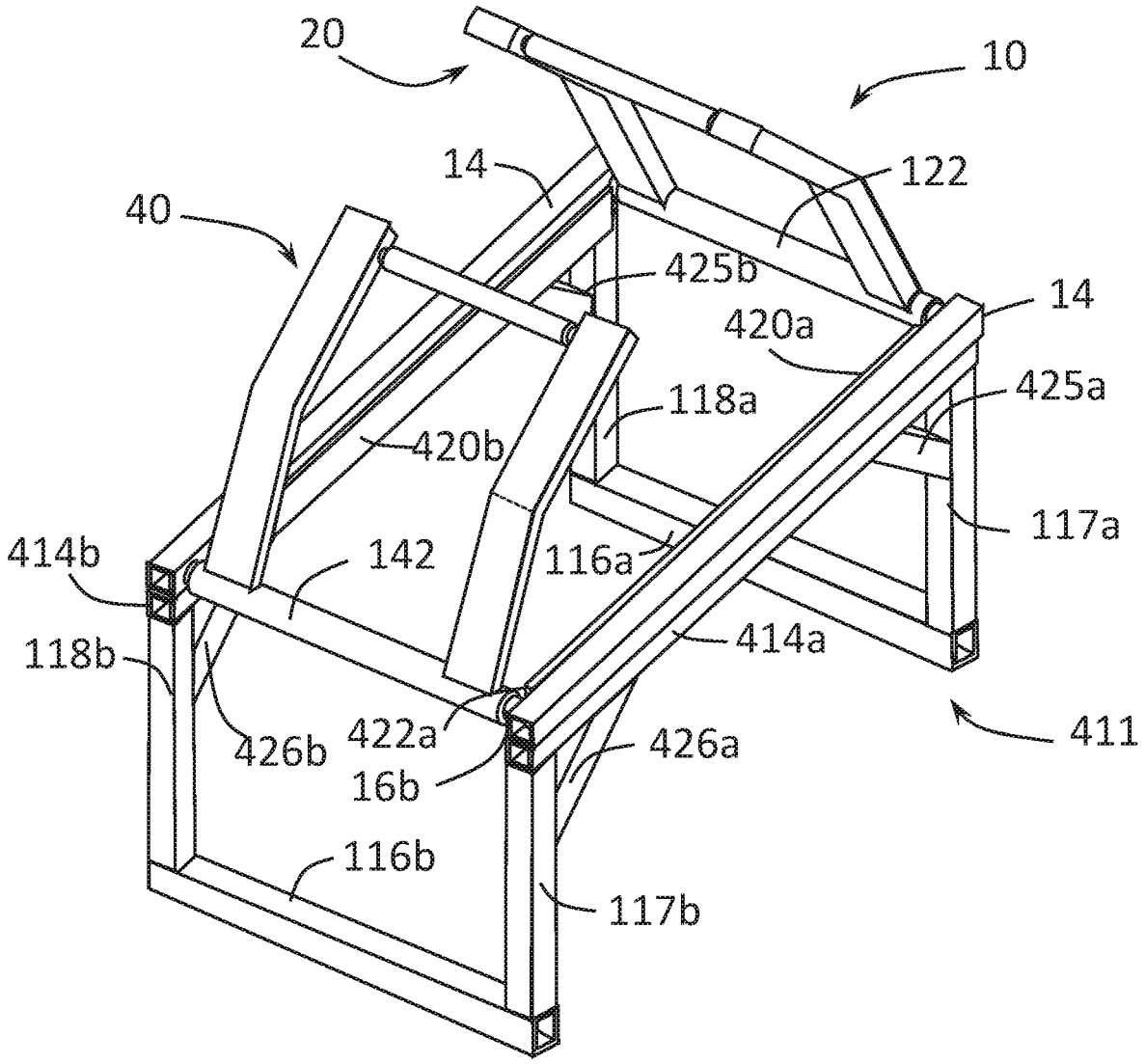
FIG. 35 illustrates the ratcheting auger bracing device mounted upon the separate elevating frame of FIG. 32.

As shown in FIG. 35, the bracing device 10 can be position above the separate elevating frame 411 after the frame 411 is position around the well hole and the protruding lengths of auger sections 80 (as shown by example in FIG. 21), and then placed down onto the upper surface of the elevating frame 411. The pair of side bars 14 of the support frame 11 of the bracing device 10 are placed on top of the respective base sides bars 414 of the elevating frame 411, the features described above preventing or inhibiting horizontal movement of the support frame 11 relative to the elevating frame 411 in both the longitudinal direction (along the length parallel with the side base bars 414) the lateral direction.

The material of the support frame, elevating frame, and pivotable braces is typically metal, and in particular is steel, aluminum, iron, or other metal or alloy, and is typically in a cylindrical form, including either a round cylinder or a square cylinder, with rigid joints secured by welding.

I claim:

1. An auger bracing device, comprising:

(a) a support frame comprising a peripheral tubular assembly comprising a first end and a second end, having an interior area bounded by the peripheral tubular assembly;

(b) a first pivotable brace, including a proximal hinge end secured pivotally to the first end of the support frame, a distal elongated end bar having opposed lateral ends, a pair of opposed arms, each having a distal end rigidly connecting to the respective opposed lateral ends of the distal end bar, and a proximal end rigidly connecting to the proximal hinge end, and an outer cylindrical bar surrounding coaxially, and rotatable freely around, the distal elongated end bar; and (c) a second pivotable brace, including a proximal hinge end secured pivotally to the second end of the support frame, a distal elongated end bar having opposed lateral ends, a pair of opposed arms, each having a distal end rigidly connecting to the respective opposed lateral ends of the distal end bar, and a proximal end rigidly connecting to the proximal hinge end, and an outer cylindrical bar surrounding coaxially, and rotatable freely around, the distal elongated end bar.

2. The auger bracing device according to claim 1, wherein each arm of the pair of opposed arms of the first pivotable brace and the pair of opposed arms of the second pivotable brace is linear and straight.

3. The auger bracing device according to claim 2, wherein the proximal hinge end comprises one or more outer cylindrical bar surrounding coaxially, and rotatable freely around, the respective first and second end bars of the support frame.

4. The auger bracing device according to claim 1, wherein each arm of the pair of opposed arms of the first pivotable brace and the pair of opposed arms of the second pivotable brace consists of a proximal arm member and a distal arm member joined at a non-linear, angular joint with the proximal arm member.

5. The auger bracing device according to claim 4, wherein the proximal hinge end comprises one or more outer cylindrical bar surrounding coaxially, and rotatable freely around, the respective first and second end bars of the support frame.

6. The auger bracing device according to claim 4, wherein the proximal arm member extends along an axis, the distal arm member extends along an axis, and an angle between the respective axes of the proximal arm member and the distal arm member is from about 10° to about 50°.

7. The auger bracing device according to claim 1, wherein the peripheral tubular assembly includes a pair of spaced-apart elongated side bars, a first elongated end bar connecting the pair of side bars at a first end, and a second elongated end bar connecting the pair of side bars at a second end opposite the first end, and wherein the proximal hinge end of the first pivotable brace comprises a tubular cylinder concentrically and pivotally around the first end bar, and the proximal hinge end of the second pivotable brace comprises a tubular cylinder concentrically and pivotally around the second end bar.

8. An elevated auger bracing device, comprising the auger bracing device according to claim 1, and further comprising an elevating frame that includes a lower base, providing an interface for the elevating frame upon a ground, and a plurality of legs that elevate the support frame and the first and second pivotable braces.

9. The elevated auger bracing device according to claim 8, wherein each arm of the pair of opposed arms of the first pivotable brace and the pair of opposed arms of the second pivotable brace consists of a proximal arm member and a distal arm member joined at a non-linear, angular joint with the proximal arm member.

10. The elevated auger bracing device according to claim 9, wherein each of the first pivotable brace and the second pivotable brace further includes an outer cylindrical bar surrounding coaxially, and rotatable freely around, the distal elongated end bar.

11. The elevated auger bracing device according to claim 9, wherein the proximal hinge end comprises one or more outer cylindrical bar surrounding coaxially, and rotatable freely around, the respective first and second end bars of the support frame.

12. The elevated auger bracing device according to claim 9, wherein the proximal arm member extends along an axis, the distal arm member extends along an axis, and an angle between the respective axes of the proximal arm member and the distal arm member is from about 10° to about 50°.

13. The elevated auger bracing device according to claim 8, wherein each of the first pivotable brace and the second pivotable brace further includes an outer cylindrical bar surrounding coaxially, and rotatable freely around, the distal elongated end bar.

14. The elevated auger bracing device according to claim 8, wherein the proximal hinge end comprises one or more outer cylindrical bar surrounding coaxially, and rotatable freely around, the respective first and second end bars of the support frame.

15. An elevated auger bracing device, comprising the auger bracing device according to claim 8, and further comprising an elevating frame that includes a lower base, providing an interface for the elevating frame upon a ground, and a plurality of legs that elevate the support frame and the first and second pivotable braces.

16. The elevated auger bracing device according to claim 15, wherein each arm of the pair of opposed arms of the first pivotable brace and the pair of opposed arms of the second pivotable brace consists of a proximal arm member and a distal arm member joined at a non-linear, angular joint with the proximal arm member.

17. The elevated auger bracing device according to claim 15, wherein each of the first pivotable brace and the second pivotable brace further includes an outer cylindrical bar surrounding coaxially, and rotatable freely around, the distal elongated end bar.

18. The auger bracing device according to claim 1, wherein an axis of the proximal hinge end of the first pivotable brace and an axis of the proximal hinge end of the second pivotable brace are parallel, and the first pivotable brace and the first pivotable brace are configured to pivot toward the other.

19. An auger bracing device, comprising:

(a) a support frame comprising a peripheral tubular assembly having an interior area bounded by the peripheral tubular assembly, the peripheral tubular assembly including a pair of spaced-apart elongated side bars, a first elongated end bar connecting the pair of side bars at a first end, and a second elongated end bar connecting the pair of side bars at a second end opposite the first end, and wherein the proximal hinge end of the first pivotable brace comprises a tubular cylinder concentrically and pivotally around the first end bar, and the proximal hinge end of the second pivotable brace comprises a tubular cylinder concentrically and pivotally around the second end bar;

(b) a first pivotable brace, including a proximal hinge end secured pivotally to the first end of the support frame, a distal elongated end bar having opposed lateral ends, and a pair of opposed arms, each having a distal end rigidly connecting to the respective opposed lateral ends of the distal end bar, and a proximal end rigidly connecting to the proximal hinge end; and (c) a second pivotable brace, including a proximal hinge end secured pivotally to the second end of the support frame, a distal elongated end bar having opposed lateral ends, and a pair of opposed arms, each having a distal end rigidly connecting to the respective opposed lateral ends of the distal end bar, and a proximal end rigidly connecting to the proximal hinge end.

* * * * *